US007434920B2

(12) United States Patent
Noguchi et al.

(10) Patent No.: US 7,434,920 B2
(45) Date of Patent: Oct. 14, 2008

(54) LIQUID CONTAINER FOR INK JET RECORDING APPARATUS WITH STRUCTURE TO PROMOTE GAS-LIQUID EXCHANGE

(75) Inventors: Koudai Noguchi, Tokyo (JP); Hajime Yamamoto, Fuchu (JP); Yoshinori Kojima, Kawasaki (JP); Eiichiro Shimizu, Hong Kong (HK)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/149,138

(22) Filed: Jun. 10, 2005

(65) Prior Publication Data

US 2005/0275698 A1 Dec. 15, 2005

(30) Foreign Application Priority Data

Jun. 11, 2004 (JP) ..... 2004-173472

(51) Int. Cl.
*B41J 2/175* (2006.01)

(52) U.S. Cl. ..... 347/85; 347/86

(58) Field of Classification Search ..... 347/7, 347/85, 86, 87, 84
See application file for complete search history.

(56) References Cited

U.S. PATENT DOCUMENTS

| | | | | |
|---|---|---|---|---|
| 5,509,140 | A | 4/1996 | Koitabashi et al. | 347/86 |
| 5,821,964 | A * | 10/1998 | Bidwell | 347/86 |
| 6,007,191 | A | 12/1999 | Fujii et al. | 347/87 |
| 6,012,808 | A * | 1/2000 | Koitabashi et al. | 347/86 |
| 6,123,420 | A | 9/2000 | Higuma et al. | 347/86 |
| 6,137,512 | A | 10/2000 | Higuma et al. | 347/86 |
| 6,293,660 | B1 * | 9/2001 | Kishida et al. | 347/86 |
| 6,398,353 | B1 * | 6/2002 | Tsuchii | 347/86 |
| 6,450,630 | B2 * | 9/2002 | Kanaya et al. | 347/86 |
| 6,502,931 | B2 | 1/2003 | Udagawa et al. | 347/86 |
| 6,623,092 | B2 * | 9/2003 | Kim et al. | 347/7 |

(Continued)

FOREIGN PATENT DOCUMENTS

CN 1242301 1/2000

(Continued)

OTHER PUBLICATIONS

English language translation of Chinese Office Action dated Mar. 28, 2008 from corresponding Chinese Application No. 200510078548.9.

*Primary Examiner*—Stephen D Meier
*Assistant Examiner*—Carlos A Martinez, Jr.
(74) *Attorney, Agent, or Firm*—Fitzpatrick, Cella, Harper & Scinto

(57) ABSTRACT

A liquid container includes a negative pressure producing member accommodating chamber accommodating a negative pressure producing member for absorbing and retaining the liquid, and a liquid containing chamber for containing the liquid. The liquid containing chamber is in fluid communication with the negative pressure producing member accommodating chamber through a communicating portion, and is substantially sealed except for the communicating portion. A partition wall partitions the liquid container into the negative pressure producing member accommodating chamber and the liquid containing chamber except for the communicating portion. The negative pressure producing member is provided with a recess at a position corresponding to the communicating portion, wherein the recess forms a space and a ceiling portion of the space provided functions as a gas introduction surface which is substantially horizontal when the liquid container is in an in-use orientation.

6 Claims, 18 Drawing Sheets

U.S. PATENT DOCUMENTS

| | | | | |
|---|---|---|---|---|
| 6,685,309 | B2 * | 2/2004 | Jones et al. | 347/86 |
| 2002/0012033 | A1 * | 1/2002 | Iwanaga et al. | 347/86 |
| 2002/0167570 | A1 * | 11/2002 | Udagawa et al. | 347/85 |
| 2005/0157129 | A1 * | 7/2005 | Merz et al. | 347/87 |

FOREIGN PATENT DOCUMENTS

| | | |
|---|---|---|
| EP | 894630 | 2/1999 |
| EP | 956959 | 11/1999 |
| JP | 2000-209106 | 11/2000 |
| JP | 2000-309106 | 11/2000 |

* cited by examiner (a)

(b)

LIQUID CONTAINER FOR INK JET RECORDING APPARATUS WITH STRUCTURE TO PROMOTE GAS-LIQUID EXCHANGE

FIELD OF THE INVENTION AND RELATED ART

The present invention relates to an ink cartridge or a liquid container for accommodating ink to be supplied to the ink jet recording head, and a manufacturing method therefor.

Generally, the ink cartridge or liquid container in the field of ink jet recording, is provided with a structure for adjusting an ink retaining force for the ink accommodated in the ink cartridge in order to satisfactorily supply the ink to a recording head for ejecting the ink. The retaining force is called "negative pressure" since it is effective to maintain a negative pressure at the ink ejection portion of the recording head with respect to the ambient pressure.

In U.S. Pat. No. 5,509,140 which has been assigned to the Assignee of the present application, for example, a proposal has been made as to an ink cartridge having a liquid containing chamber, wherein an ink accommodation capacity per unit volume of the ink cartridge is increased, while using an ink negative pressure producing member, and wherein the ink supply is stabilized.

FIG. 18, (a) shows a schematic sectional view of an ink cartridge of such a structure. The inside of the ink cartridge 10 is separated into two spaces by a partition wall having a communication port (communicating portion) 40. One of the two spaces is a liquid containing chamber 36 which is hermetically sealed except for the communication port 40 of the partition wall 38 and which accommodate the ink 25 directly (substantially without ink retaining foam or the like), and the other space is a negative pressure producing member accommodating chamber 34 for accommodating the negative pressure producing member 32. A wall surface defining the negative pressure producing member accommodating chamber 34 is provided with an air vent (air vent) 12 for introducing the ambient air into the ink cartridge 10 in accordance with consumption of the ink, and a supply port 14 for supplying the ink out to a recording head portion (unshown). In FIG. 18, the region in which the negative pressure producing member 32 retain the ink is indicated by hatching lines. The ink accommodated in the space is indicated by dots.

With this structure, the ink in the negative pressure producing member 32 is consumed by an unshown recording head, and when the ink interface 61 shown in FIG. 18, (a) is reached, the air is introduced from the air vent 12 into the negative pressure producing member accommodating chamber 34 with the consumption of the ink, and the ink enters the liquid containing chamber 36 through the communication port 40 formed in the partition wall 38. In place of the air, the ink is supplied into the negative pressure producing member 32 in the negative pressure producing member accommodating chamber 34 through the communication port 40 of the partition wall from the liquid containing chamber 36 (gas-liquid exchanging operation). Therefore, even if the ink is consumed by the recording head, the ink is supplied into the negative pressure producing member 32 correspondingly to the consumption of the ink, so that negative pressure producing member 32 retains a constant amount of the ink (that is, the position of the interface 61 is maintained, by which the negative pressure relative to the recording head is kept substantially at a constant level, thus stabilizing the ink supply to the recording head. Such a downsized ink cartridge providing a high use efficiency has been commercialized by the Assignee of the present application and is still practically used.

In the example of FIG. 18, (a), air introducing groove or grooves 50 are provided adjacent the communicating portion for fluid communication between the negative pressure producing member accommodating chamber and the ink reservoir chamber as a structure for promoting the ambient air introduction, and adjacent the neighborhood of the air vent, there is provided a space (buffer chamber) 44 which is free of negative pressure producing member 32, by ribs 42.

On the other hand, in the U.S. Pat. No. 6,137,512 which has been assigned to the Assignee of the present application, a proposal has been made as to an ink cartridge using fibers of olefin resin material having a thermoplastic property as the negative pressure producing member in the above-described ink cartridge. The ink cartridge is excellent in keeping the stability of the ink in storage, and is also excellent in the recycling property since the ink cartridge casing and the fibrous material are made of similar kind materials.

SUMMARY OF THE INVENTION

Recently, the recording speed of the ink jet recording apparatus is increased, and therefore, the ink supply amount per unit time from the ink cartridge into the ink jet head is increased. When the ink continues to be supplied at a high rate with the above-described structure of the ink cartridge, the supply of the air into the liquid containing chamber does not catch up the high rate ink supply with the result that liquid surface (interface) in the absorbing material lowers, and the ink supply does not meet the requirement to keep the ink level, in some cases. If this occurs, the ink supply may become disconnected with some ink remaining in the liquid containing chamber (this will be called "ink disconnection").

Referring to FIG. 18, the description will be made as to a mechanism of the ink disconnection in the conventional ink cartridge. FIG. 18, (a) illustrates gas-liquid exchange in an ink container used with a conventional ink jet recording apparatus when the ink supply amount to the ink jet recording head is relatively small; FIG. 18, (b) illustrates the same when the ink supply amount to the ink jet recording head is increased; FIG. 18, (c) illustrates the same when the ink supply amount to the ink jet recording head continues to increase.

In the case of FIG. 18, (a), the ink supply amount from the ink container to the ink jet recording head (unshown) is relatively small, so that amount of the ink discharged from the liquid containing chamber 36 matches the amount of the air introduced into the liquid containing chamber 36. Namely, the gas-liquid interface 61 in the negative pressure producing member 32 is maintained substantially at a constant position which is adjacent a point 51 where the upper end of the air introducing groove 50 contacts the negative pressure producing member 32.

However, the case that ink supply amount for ink jet recording head (unshown) is increased will be considered. The path of the air which is subjected to the gas-liquid exchange is a part or entirety of the region of a line at which the upper end of the air introducing groove 50 (a line extending in the widthwise direction in the sectional view of FIG. 18, (a)) and the negative pressure producing member 32 (indicated by point 51 in the sectional view), and therefore, the introduction of the air into the ink accommodating chamber is not enough to meet the increased ink supply amount or rate. Therefore, the ink retained in the negative pressure producing member is supplied out in addition to such an amount of the ink supplied out of the ink accommodating chamber as meets the amount of the air introduced through the path of the air (operation A), and the gas-liquid interface 61 in the negative pressure producing member 32 lowers as shown in FIG. 18, (b).

With the reduction of the gas-liquid interface 61, the area of the gas introduction surface 33 of the negative pressure producing member 32 which is contacted to the air introducing groove 50 expands, so that wider air path is provided, thus tending to introduce the air at a higher rate into the liquid containing chamber 36 (operation B).

These operation An and operation B are combined, and the gas-liquid interface 61 lowers to expand the area of the surface 33 for gas introduction until the introduction of such an amount of the air into the liquid containing chamber as meets the ink supply amount. Finally, the lowering gas-liquid interface is stabilized at a position when the ink discharge rate and the ink supply rate through the ink supply port are balanced, by which the increased amount of the ink can be supplied continuously.

However, in such a case, the negative pressure (absolute value) increases due to the lowering of the gas-liquid interface 61 with the result that stabilized ink supply with the proper negative pressure to the ink jet recording head is not carried out, and therefore, the printing may be disturbed. In addition, if the ink supply amount increases to such an extent as 3 times, 5 times or like the normal in supply rate, as is not expected conventionally, the above-described lowering of the gas-liquid interface 61 is not enough to each of the balance point, and the gas-liquid interface 61 in the negative pressure producing member 32 continues to lower beyond the effect of expansion of the area of the gas introduction surface 33, with the result that gas-liquid interface 61 lowers down to the ink supply port 14, thus causing the ink disconnection.

In the conventional ink cartridge, as described hereinbefore, the gas introduction surface is substantially perpendicular to the gas-liquid interface in the negative pressure producing member. More particularly, the gas introduction surface opens in the direction of capillary force gradient (substantially vertical direction) of the negative pressure producing member 32, and therefore, the gas-liquid exchange effect corresponding to the opening area (increase of the rate of the air introduction).

Accordingly, it is a principal object of the present invention to provide an ink cartridge and an ink jet recording apparatus wherein the ink supply is stabilized so as not to cause ink disconnection or printing disturbance or the like in ink jet recording at high speed.

According to an aspect of the present invention, the position of the gas introducing portion (gas introduction surface) for gas-liquid exchanging operation is substantially horizontal in the attitude of the container in use, by which when the gas-liquid interface in the negative pressure producing member reaches the gas introduction surface as a result of ink consumption through the ink supply port, the area of the air path into the ink accommodating chamber is drastically increases, so that amount of the air meeting the amount over the ink discharge can be introduced into the ink accommodating chamber without delay. Therefore, the stabilized ink supply to the ink jet recording head is accomplished without occurrence of ink disconnection as in the conventional ink jet recording. By this, a highly reliable ink cartridge and ink jet recording apparatus suitable for high speed operation can be provided.

According to another aspect of the present invention, there is provided a liquid container comprising a negative pressure producing member accommodating chamber accommodating a negative pressure producing member for absorbing and retaining the liquid, said negative pressure producing member accommodating chamber having a supply port for supplying the liquid to liquid an ejection recording head and an air vent for fluid communication with ambient air; a liquid containing chamber for containing the liquid, said liquid containing chamber being in fluid communication with said negative pressure producing member accommodating chamber through said communicating portion and being substantially sealed except for said communicating portion; and a partition wall for partitioning said liquid container into said negative pressure producing member accommodating chamber and said liquid containing chamber except for said communicating portion; wherein said negative pressure producing member is provided with a recess at a position corresponding to said communicating portion; wherein a ceiling portion of a space provided by said recess functions as a gas introduction surface which are substantially horizontal when said liquid container takes a position in use.

According to a further aspect of the present invention, there is provided a liquid container, wherein said negative pressure producing member includes a first and second negative pressure producing members which are press-contacted to each other; a capillary force of said first negative pressure producing member is higher than a capillary force of said second negative pressure producing member; an interface of a press-contact portion between said first and second negative pressure producing members crosses with said partition wall; said first negative pressure producing member is in fluid communication with said communicating portion and with said supply port; and the interface of the press-contact portion between said first and second negative pressure producing members is disposed above said gas introduction surface.

According to a further aspect of the present invention, there is provided a liquid container, wherein the ink is retained over an entire area of the interface of the press-contact portion between the first and the second negative pressure producing member irrespective of an attitude taken by said liquid container.

According to a further aspect of the present invention, there is provided a liquid container, further comprising a structural member provided in a space formed by said recess and contacted to said negative pressure producing member, said structural member being disposed on an extension of a contact plane between a surface of an inner wall constituting said negative pressure producing member accommodating chamber and a surface of said negative pressure producing member.

According to a further aspect of the present invention, there is provided a liquid container, further comprising a projection provided in a space formed by said recess and disposed on an extension of a contact plane between a surface of an inner wall constituting said negative pressure producing member accommodating chamber and a surface of said negative pressure producing member, said projection being effective to block a direct fluid communication between a surface of said negative pressure producing member directly contacting the liquid and said contact surface.

According to a further aspect of the present invention, there is provided a liquid container, further comprising a structural member disposed on an extension of an apex line where inner walls constituting said negative pressure producing member accommodating chamber cross with each other, said structural member has a dimension in a direction crossing with said apex line.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
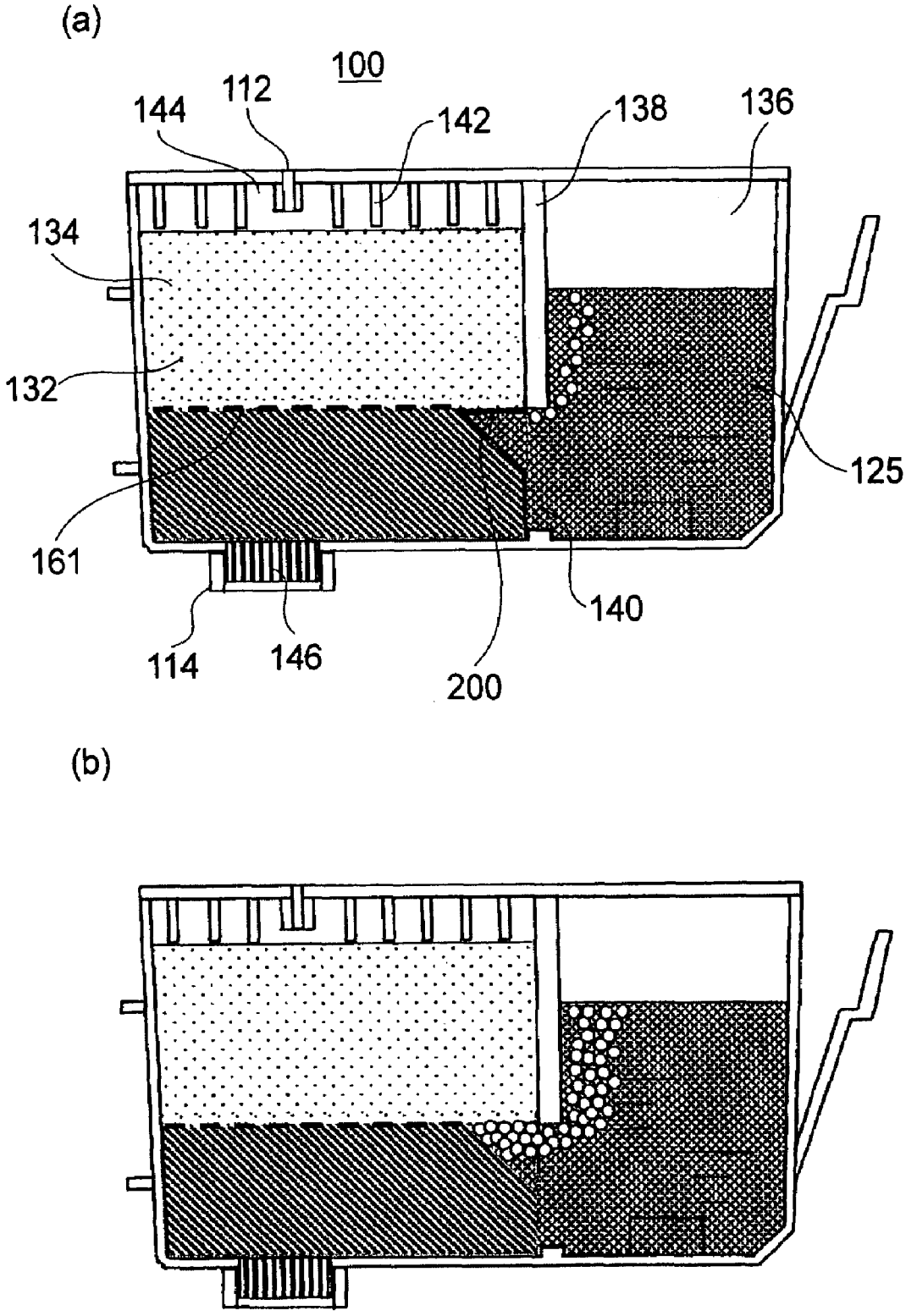
FIG. 1 is a schematic sectional view of a liquid container according to a first embodiment of the present invention, wherein (a) illustrates a state in which an amount of consumption per unit time is relatively small, and (b) illustrates a state in which the amount of the ink consumption is relatively large.

Referring to the accompanying drawings, the description will be made as to the preferred embodiments of the present invention.

In the following descriptions, the liquid used with the liquid supply method, the liquid supplying system and the liquid container according to the present invention is ink, but the present invention is applicable with the liquid other than ink. For example, in the field of the ink jet recording, the liquid may be processing liquid.

In each of the sectional views referred to in the following descriptions, such regions in the negative pressure producing member as retain the ink are indicated by hatching lines, and the ink accommodated in a space (directly) is indicated by dots.

All of the sectional views show the state in which the ink has been consumed from the negative pressure producing member and the ink is consumed from the liquid containing chamber (gas-liquid exchange occurs).

The reference numerals in the Figures are fundamentally common.

First Embodiment

FIG. 1 is a schematic sectional view of an ink cartridge according to the first embodiment of the present invention, wherein (a) shows a state in which the ink consumption amount per unit time (ink consumption rate) is relatively small, and (b) shows a state in which the ink consumption amount per unit time is relatively large.

The description will be made as to the structure of the ink cartridge (liquid container).

In FIG. 1, (a), the liquid container (ink cartridge) 100 is partitioned by a partition 138 into a negative pressure producing member accommodating chamber 134 which accommodates a negative pressure producing member 132 and which is in fluid communication with the ambient air through an air vent 112 provided at an upper portion thereof and which is in 40 combination with an ink supply port 114 at the lower portion thereof, and a liquid containing chamber 136 which accommodates the liquid (ink 125) in which is substantial hermetically sealed. The negative pressure producing member accommodating chamber 134 and liquid containing chamber 136 are in fluid communication with each other only through the communicating portion 140 formed in the partition 138 adjacent the bottom portion of the ink cartridge 100. The inner upper wall of the ink cartridge 100 defining the negative pressure producing member accommodating chamber 134 is provided with a plurality of ribs 142 extended inwardly of the container, ribs 142 being in contact with the negative pressure producing member 132 which is accommodated in the negative pressure producing member accommodating chamber 134 in a compressed state. By the provision of the ribs 142, an air buffer chamber 144 is formed between the upper wall and the upper surface of the negative pressure producing member.

In an ink supply tube having the supply port 114, there is provided a press-contact member 146 which has a capillary force higher than that of the negative pressure producing member and which has a physical strength which is higher than that of the negative pressure producing member. The press-contact member 146 is press-contacted to the negative pressure producing member 132.

The gas introduction surface will be described.

A part of the negative pressure producing member 132 is provided with a recess which has been formed by cutting a part of the negative pressure producing member into a V-shape. By doing so, a gas introduction surface 200 is substantially horizontal. Therefore, when the liquid surface height of the ink 125 in the liquid containing chamber is higher than the level of the gas introduction surface 200, the ink 125 in the liquid containing chamber directly contacts the gas introduction surface 200.

When the liquid surface height of the ink 125 in the liquid containing chamber becomes lower than the gas introduction surface 200, the ink 125 in the liquid containing chamber reaches the gas introduction surface 200 through the negative pressure producing member 132.

The description will be made as to the material of the negative pressure producing member.

The material of the negative pressure producing member may be porous material such as polyurethane foam, fibrous material or the like and another material capable of producing capillary force. The use of fibrous materials is advantageous in that latitude of material selection is wider than the latitude in the porous material porous material or the like such as urethane, and therefore, the selection can be made in consideration of the ink hydrophilic property. In addition, the material of the fibers may be thermoplastic resin material which are the same as or similar to the material of the main assembly of the ink cartridge. In this case, the ink cartridge is of high recycling property. In addition, the fiber may comprise a core-sleeve structure with which in the crossing parts of the fibers can be assuredly fixed, so that the ink retention force (capillary force) is stabilized, and the ink holding particularly property, and therefore, the negative pressure property are stabilized. In this embodiment, the fiber of the fibrous material of the negative pressure producing member comprises a core portion of polypropylene and a sheath portion of olefin resin material of polyethylene, and the fibers re provided by heat molding. Then, the difference in the melting point between the polyethylene and the polypropylene is effectively used by setting the temperature during the heat molding at a level between the melting point of the material having a low melting point and the melting point of the material having a high melting point (for example, setting it at the level higher than the melting point of the polyethylene and lower than the melting point of the polypropylene). By doing so, the fibrous material having the low melting point can be used as adhesive material, so that crossing portions between the fibers can be fixed by melting the polyethylene having the relatively low melting point. Therefore, the ink cartridge of the present invention can be easily manufactured.

Confounded fibrous material effective to produce a predetermined capillary force, particularly, the confounded fibrous material comprising as a base material of polyolefin resin material represented by the polyethylene or polypropylene, exhibits a high absorption speed as compared with a foam member effective to produce the same capillary force, and therefore, even if the ink consumption occurs such that ink liquid surface height in the liquid containing chamber 136 is lower than the gas introduction surface 200, the ink quickly reaches the gas introduction surface 200 through the negative pressure producing member 132. By this, the meniscus in the gas introduction surface 200 which has been broken (the state in which the gas introduction path for the gas-liquid exchange is open) is quickly regenerated (the gas introduction path for the gas-liquid exchange is closed).

In the embodiment, this is provided by cutting the negative pressure producing member to form recess. Doing so is particularly effective in the case of the negative pressure producing member of fibrous material. However, the present invention is not limited to such a recess. For example, when the fibrous material is subjected to the heat molding, a mold corresponding to the recess is used, and heat molding using it can form the recess without cutting the negative pressure producing member after molding.

The description will be made as to gas-liquid exchanging operation.

The negative pressure producing member (negative pressure producing member) 132 accommodated in the negative pressure producing member accommodating chamber 134 can be deemed to have a great number of capillary tubes, which function to produce the negative pressure by the meniscus forces. Normally, a sufficient amount of ink is retained in the negative pressure producing member immediately after start of use of the liquid container, and therefore, the potential heads of the respective capillary tubes are sufficiently high.

With the consumption of the ink through the ink supply port 114, the pressure at the bottom portion of the negative pressure producing member accommodating chamber 134 lowers, and the potential heads of the capillary tubes also lowers. Namely, the gas-liquid interface 161 of the negative pressure producing member 132 lowers in accordance with the consumption of the ink.

When the ink is further consumed, the gas-liquid interface 161 lowers to such an extent shown in FIG. 1, (a). With even further consumption of the ink, the meniscus of the gas introduction surface 200 provided in the negative pressure producing member is broken, and the ambient air is introduced into the liquid containing chamber 136 while the gas-liquid interface 161 hardly lowers from the position shown in FIG. 1, (a).

When the ambient air is introduced into the liquid containing chamber 136, the pressure in the liquid containing chamber 136 becomes higher than the pressure at the bottom portion of the negative pressure producing member accommodating chamber, and the ink is supplied into the negative pressure producing member accommodating chamber 134 from the liquid containing chamber 136 so as to cancel the pressure difference.

The gas introduction surface is substantially horizontal in this embodiment, and therefore, the gas introduction surface is substantially parallel with the gas-liquid interface, so that meniscus force in the ambient air introduction surface 200 is substantially constant. So, in the case that ink consumption amount per unit time further increases, the meniscus are broken one after another as shown in FIG. 1, (b), and a wide gas introduction surface 200 are drastically provided. Namely, numerous air introduction paths are assuredly provided, so that large amount of the air can be speedily introduced into the ink accommodating chamber to meet the discharge of the ink without lowering of the gas-liquid interface in the negative pressure producing member. When the ink consumption amount through the ink supply port 114 decreases or the ink consumption is interrupted, the gas-liquid interface rises, and the meniscus of the gas introduction surface is regenerated, thus stopping the gas-liquid exchanging operation.

Therefore, the gas-liquid exchanging operation is possible without lowering of the gas-liquid interface from the beginning of the gas-liquid exchanging operation, as described hereinbefore, the ink can be supplied into the ink jet recording head stably without the conventional ink disconnection. By this, a highly reliable ink cartridge and ink jet recording apparatus suitable for high speed operation can be provided.

The description will be made as to flow resistance during ink supply to the ink jet recording head.

Figure 2:
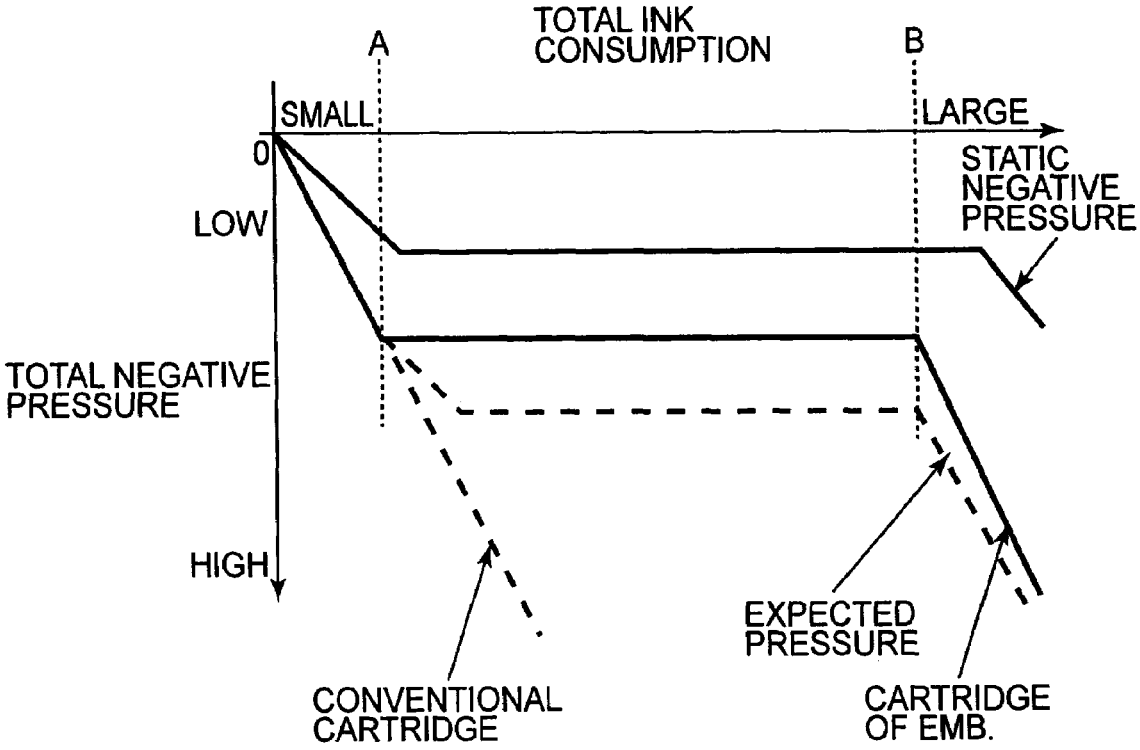
FIG. 2 shows flow resistance during ink supply to the ink jet recording head, wherein the ordinate represents dynamic negative pressure (total negative pressure), and the abscissa represents the total amount of ink consumption supplied from the ink cartridge.

FIG. 2 is a graph showing flow resistance during ink supply into the ink jet recording head, wherein the ordinate is a dynamic negative pressure (total negative pressure) including flow resistance during the ink supply, and the abscissa is a total consumption amount of the ink from the ink cartridge. There are shown the total negative pressure in a conventional ink cartridge, the total negative pressure of the ink cartridge of this embodiment from the beginning to the end of the ink consumption, the total negative pressure when the gas-liquid exchange in the conventional ink cartridge are assumed to be enough, and the changes in the negative static pressure in the conventional ink cartridge and in the embodiment of the present invention. The ink supply flow rate per unit time is common for all cases.

The total negative pressure in the conventional ink cartridge increases with the consumption of the ink. This is because the gas-liquid exchange is not enough to meet the ink supply flow rate per unit time.

The graph of the predicted negative pressure is the negative pressure on the assumption that gas-liquid exchange is enough to meet the ink consumption in the conventional ink cartridge. When this is compared with the total negative pressure in the ink cartridge of this embodiment, the ink cartridge of this embodiment can supply the ink with the negative pressure which is lower than in the conventional ink cartridge.

This is because, the ink cartridge of this embodiment is capable of drastically expand the gas introduction surface as described hereinbefore, so that large amount of the air can be quickly supplied into the ink accommodating chamber to meet the ink discharge without lowering the gas-liquid interface in the negative pressure producing member. In other words, the conventional ink cartridge requires longer time to provide the gas introduction area necessary to meet the gas-liquid exchange than in the ink cartridge of this embodiment. In the ink cartridge of this embodiment, the stabilized gas-liquid exchanging operation starts before the timing at which the conventional ink cartridge stabilizes the gas-liquid exchange by the expansion of the area of the gas introduction. Therefore, in the ink cartridge of this embodiment, the flow resistance is stabilized more quickly (with less ink consumption amount) than in the conventional ink cartridge, and therefore, the stabilized ink supply is reached with a lower negative pressure.

The description will be made as to the case in which the liquid surface in the ink accommodating chamber lowers beyond the gas introduction surface.

When the ink consumption stops with the state in which the liquid surface in the ink accommodating chamber 136 is lower than the gas introduction surface 200, the ink is supplied from the liquid containing chamber 136 into the negative pressure producing member accommodating chamber 134 so as to cancel the difference between the pressure in the liquid containing chamber 136 and the pressure at the bottom portion of the negative pressure producing member accommodating chamber.

The ink in the ink accommodating chamber 136 supplied from the negative pressure producing member accommodating chamber 134 absorbs the ink up by the capillary force of the negative pressure producing member, and therefore, the broken meniscus is regenerated, thus stopping the air introduction into the ink accommodating chamber. Namely, the ink discharge from the ink accommodating chamber is stopped, and therefore, no pressure is applied to the ink jet recording head by leakage of the ink from the ink cartridge.

Second Embodiment

Figure 3:
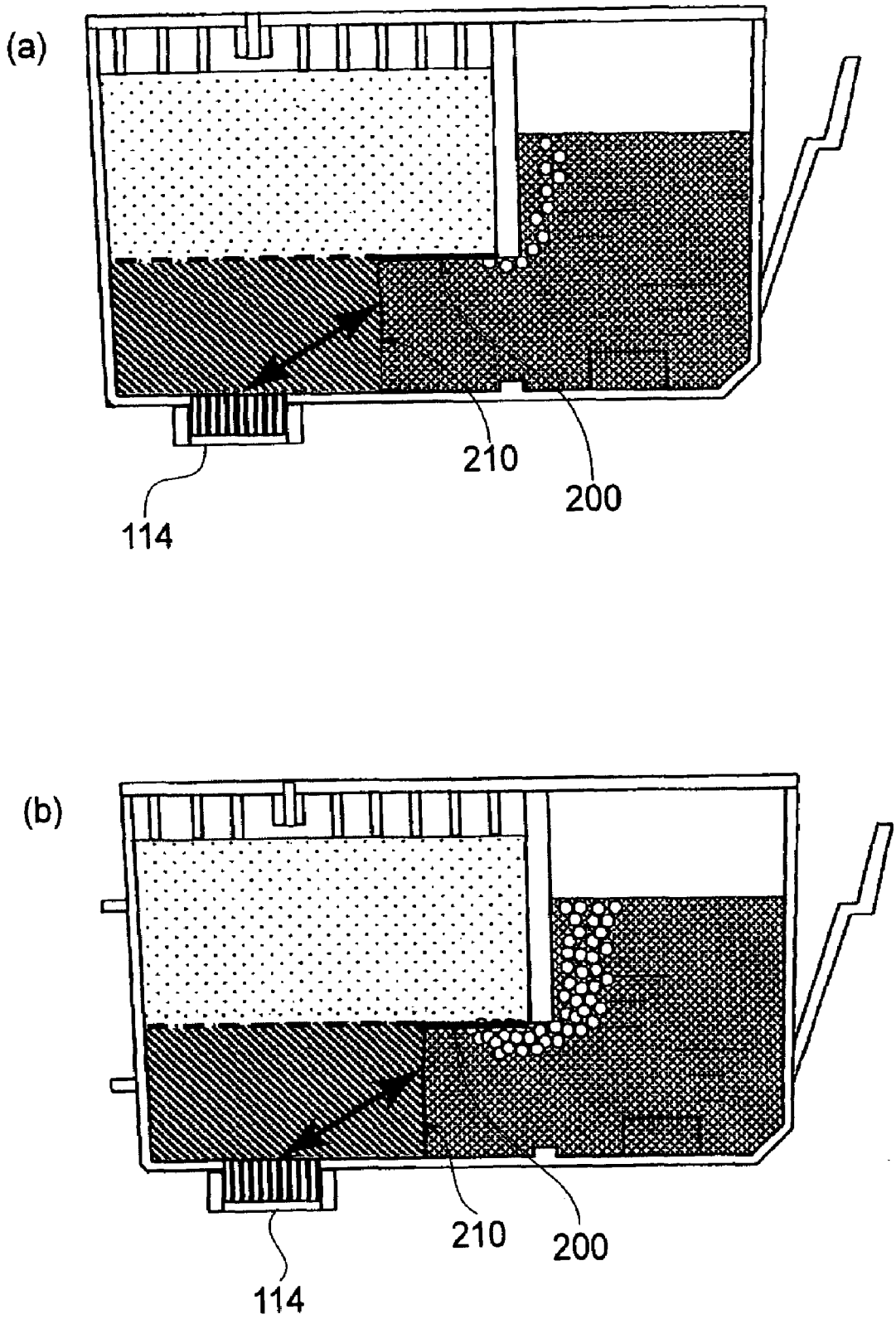
FIG. 3 is a schematic sectional view of the liquid container according to the second embodiment of the present invention, wherein (a) illustrates a state in which an amount of consumption of the ink per unit time is relatively small, and (b) illustrates a state in which an amount of consumption of ink per unit time is relatively large.

FIG. 3 is a schematic sectional view of a liquid container according to the second embodiment of the present invention, wherein (a) shows a state in which the ink consumption amount per unit time (ink consumption rate) is relatively small, and (b) shows a state in which the ink consumption amount per unit time is relatively large.

The basic structures and operations are similar to those in first embodiment, and therefore, the detailed description of the common parts is omitted for simplicity.

What is different from the first embodiment is in the configuration (recess configuration) S of a cut-away portion of the negative pressure producing member for providing the gas introduction surface 200. In the first embodiment, the cut-away portion has a V-shaped cross-section, and in this embodiment, the cut-away portion has a rectangular cross-section as shown in FIG. 3.

This embodiment is effective to provide an additional advantage. The length from the portion 210 where the negative pressure producing member contacts the ink to the ink supply port 114 is shorter than in the first embodiment. Therefore, the flow resistance during the ink supply to the ink jet recording head is shorter than in the first embodiment, as is preferable.

Third Embodiment

Figure 4:
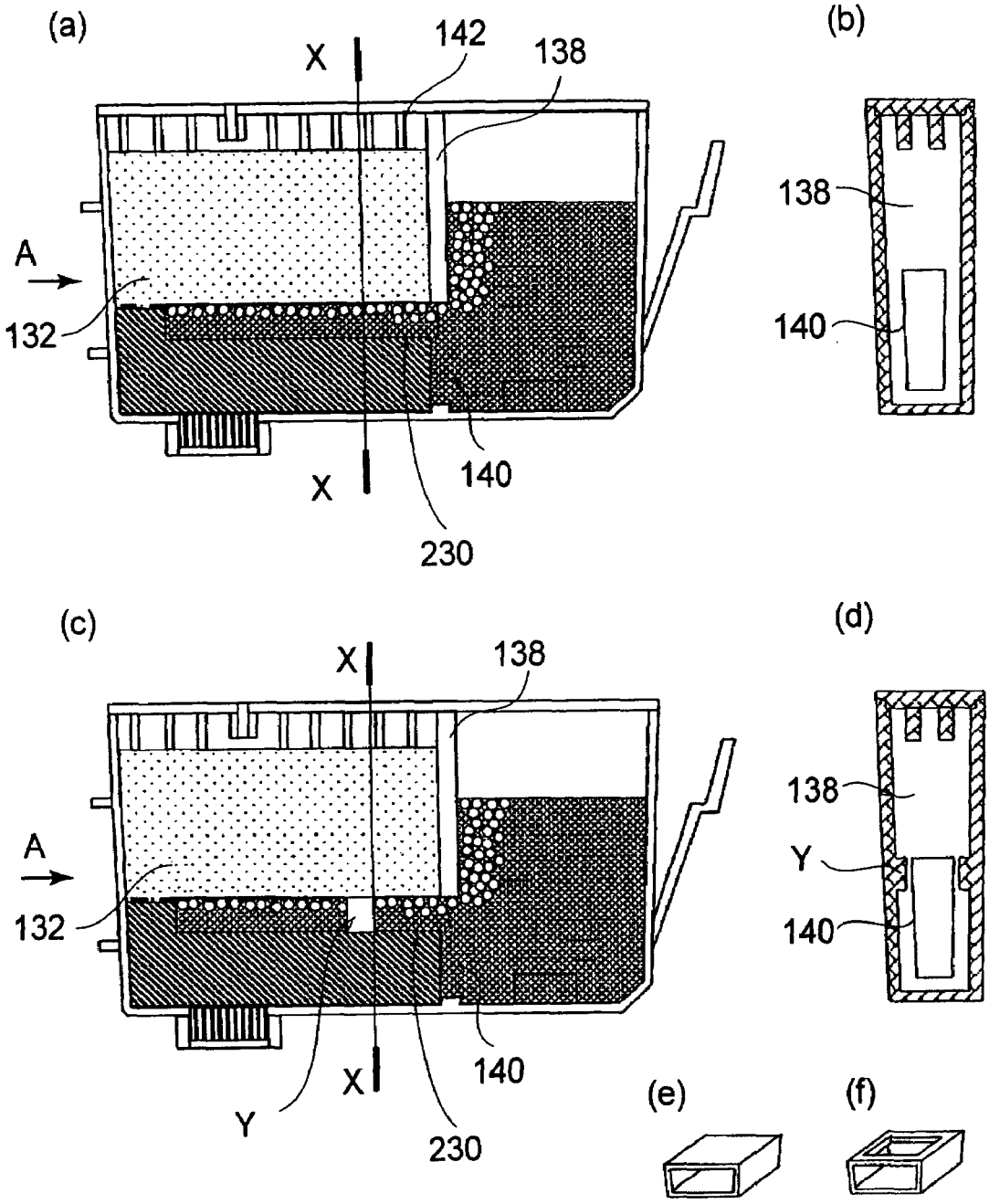
FIG. 4 is a schematic sectional view of a liquid container according to a third embodiment of the present invention, wherein (a) shows an example in which the amount of a cut-away portion is increased to elongate the gas introduction surface in the horizontal direction; (b) is a sectional view taken along X-X and seen in a direction A; (c) is a sectional view of an example in which a problem which may arise in the example of FIG. 4, (a); (d) a sectional view taken along X-X and seen in a direction A; (e) and (f) show modifications corresponding to FIG. 4, (c).

FIG. 4 is a schematic sectional view of a liquid container according to a third embodiment of the present invention, wherein (a) shows an example in which the amount of a cut-away portion is increased to elongate the gas introduction surface in the horizontal direction; (b) is a sectional view taken along X-X and seen in a direction A; (c) is a sectional view of an example in which a problem which may arise in the example of FIG. 4, (a); (d) a sectional view taken along X-X and seen in a direction A; (e) and (f) are modifications corresponding to FIG. 4, (c).

The basic structures and operations are similar to those in first embodiment, and therefore, the detailed description of the common parts is omitted for simplicity.

What is different from the foregoing embodiments is in that negative pressure producing member is cut away so as to make the gas introduction surface 200 longer in the horizontal direction in FIG. 4, (a).

With this structure, the negative pressure producing member above the cut-away portion may be pressed down by the ribs 142 or become slack down (toward the gas introduction surface) due to shock upon falling of the ink cartridge. An example of counter measurements against this problem will be described.

As shown in FIG. 4, (c), a projection is formed on an inner wall of the negative pressure producing member accommodating chamber at a position in the direction of the height matching the depth of the cut-away portion in the direction of height so as to hold the negative pressure producing member at the portion indicated by Y, by which the negative pressure producing member can be retained at the desired position. By doing so, the slacking of the negative pressure producing member or positional deviation can be prevented. Here, as shown in FIG. 4, (d) which is a sectional view taken along a line X-X, the projection is integrally molded with the wall of the ink cartridge. This is not limiting, and the projection may be provided by a separate member extending into the cut-away portion of the negative pressure producing member. In the example of FIG. 4, (c), the length of the projection at the Y portion is small, but may be the same as the length of the cut-away portion.

With this structure, the portion 230 where the negative pressure producing member contacts the ink is opposed to the ink supply port 114, and therefore, an additional advantageous effect is provided. The length from the portion 230 where the negative pressure producing member contacts the ink to the ink supply port 114 is further smaller than in the foregoing embodiment, the flow resistance during ink supply to the ink jet recording head is further small.

(Relation Between Partition Wall and Gas Introduction Surface)

Figure 5:
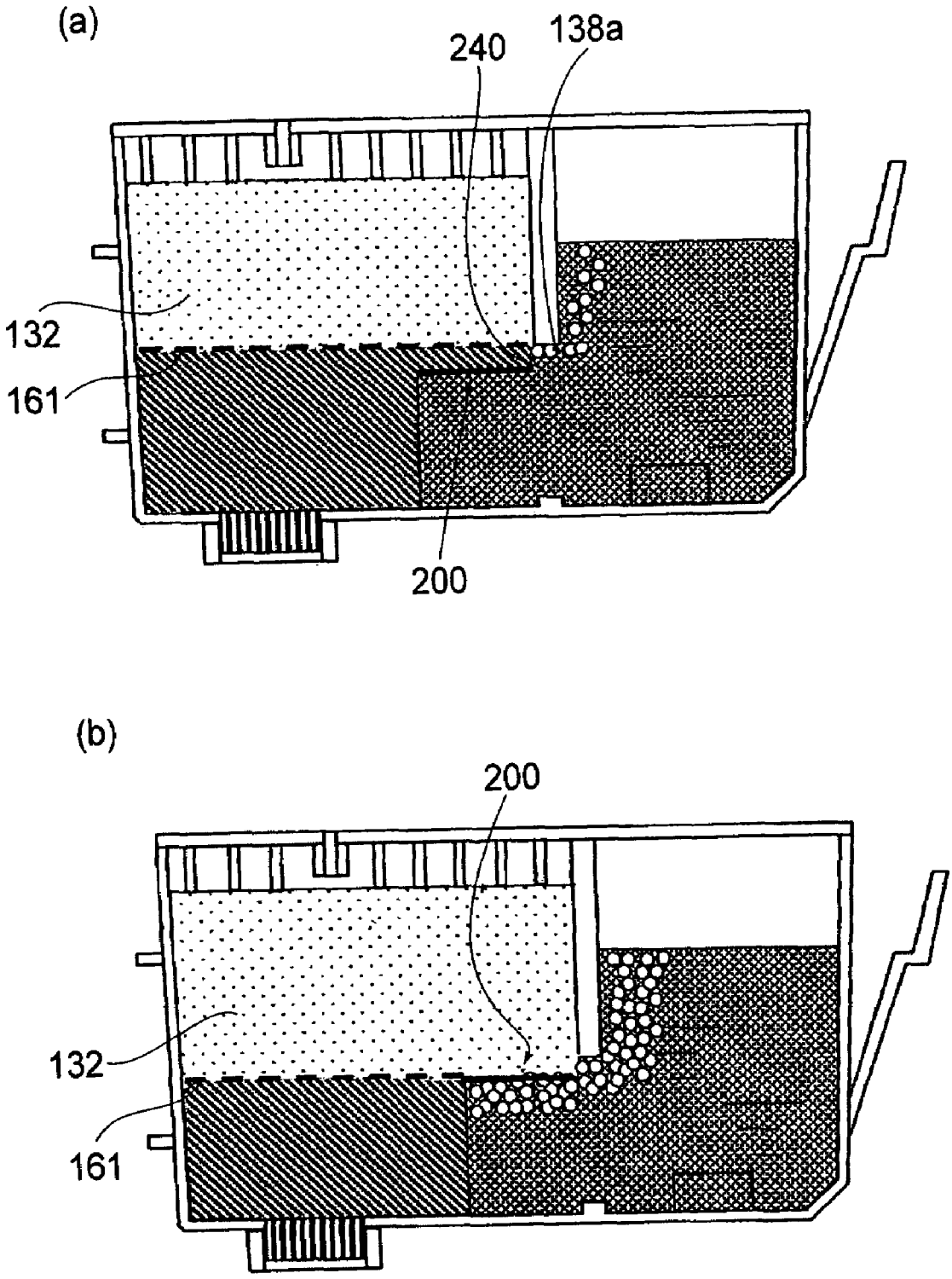
FIG. 5 is a schematic sectional view of a liquid container wherein a position of a bottom end portion of a partition wall is higher than the position of the gas introduction surface in the present invention, when (a) illustrates a state in which the amount of the ink consumption per unit time is relatively small, and (b) illustrates a state in which the amount of the ink consumption per unit time is relatively large.

FIG. 5 is a schematic sectional view of a liquid container wherein a position of a bottom end portion of a partition wall is higher than the position of the gas introduction surface in the present invention, when (a) illustrates a state in which the amount of the ink consumption per unit time is relatively small, and (b) illustrates a state in which the amount of the ink consumption per unit time is relatively large. The basic structures and operations are similar to the second embodiment, and therefore, the detailed descriptions of the common parts are omitted for simplicity.

With this structure, as shown in FIG. 5, (a), in the case that ink consumption amount per unit time is small, the gas is introduced through the portion 240 where the negative pressure producing member contacts the ink at the bottom end portion 138*a* of the partition wall 138, at the time when the gas-liquid interface 161 reaches the bottom end portion 138*a* of the partition wall 138. In the case that ink consumption amount per unit time is larger, the air path is short as shown in FIG. 5, (b), the gas-liquid interface 161 lowers to the gas introduction surface 200. Thereafter, similarly to the foregoing embodiment, the gas introduction area drastically expands, and the gas-liquid exchange is sufficiently performed with hardly lowering the gas-liquid interface any more.

Figure 6:
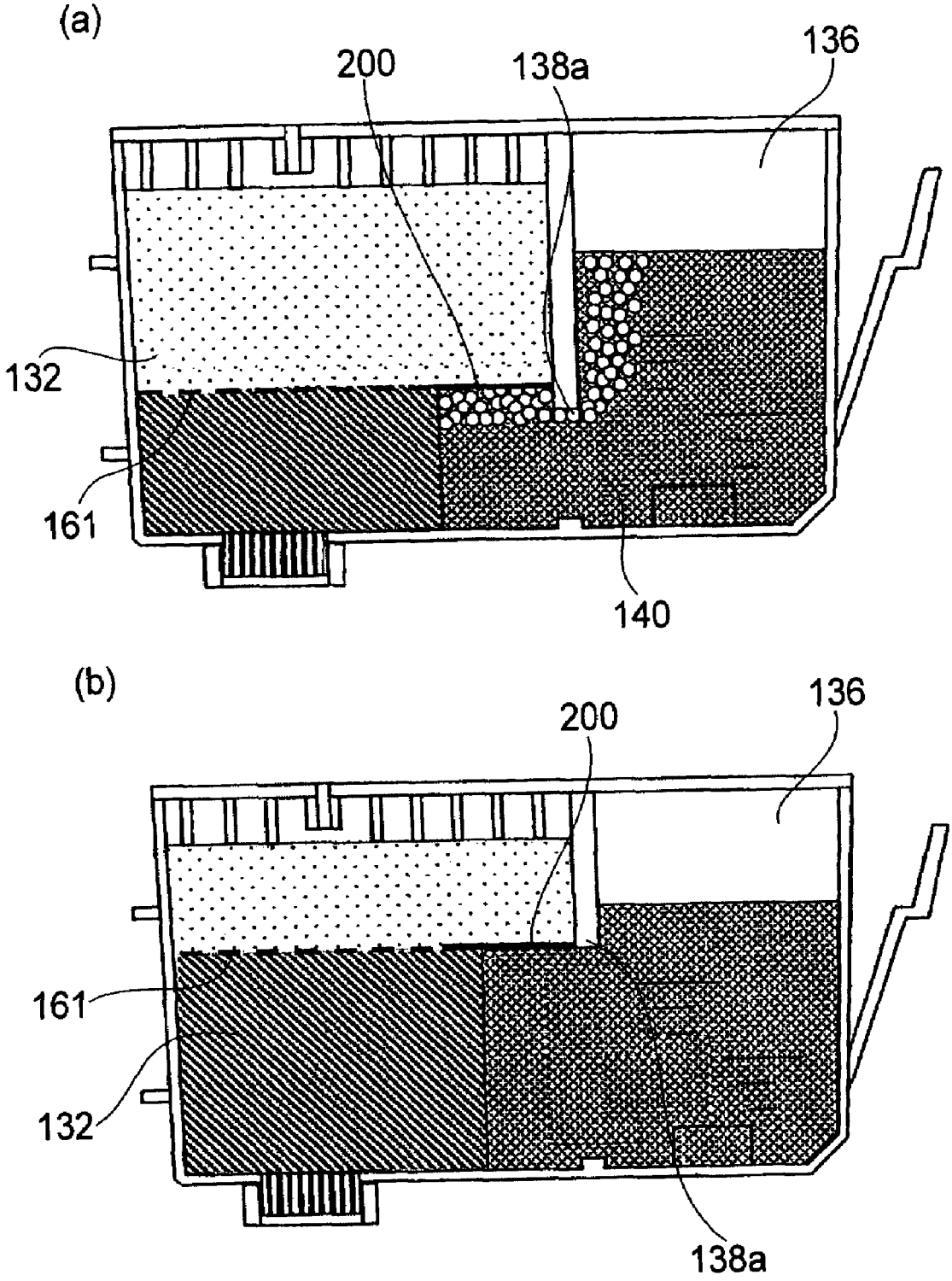
FIG. 6 is a schematic sectional view of a liquid container according to an embodiment of the present invention, wherein the position of the bottom end portion of the partition wall is lower than the position of the gas introduction surface.

FIG. 6, (a) is a schematic sectional view of a liquid container of the present invention when the position 138*a* of the bottom end portion of the partition wall 138 is lower than the gas introduction surface 200. With this structure, when the air introduced through the gas introduction surface 200 reaches the bottom end portion 138*a* of the partition wall 138, the air is introduced into the liquid containing chamber 136. The advantageous effects of the foregoing embodiments are substantially provided. However, if the position 138*a* of the bottom end portion is so low that opening of the communicating portion 140 is too narrow to permit smooth passage of the air, the air coming out through the gas introduction surface 200 may stagnate there to disturb the speedy introduction of the air into the liquid containing chamber 136. In view of this, the communicating portion 140 has a properly large size. When the bottom end portion 138*a* is lower than the gas introduction surface 200, the air may be liable to stagnate between the bottom end portion 138*a* and the space formed by the cut-away portion of the negative pressure producing member. Therefore, the structure in which the bottom end portion 138*a* of the partition wall and the gas introduction surface 200 are near to each other as shown in FIG. 6, (b), is desirable since then the speedy gas-liquid exchange is possible with the stabilized ink supply.

Fourth Embodiment

Figure 7:
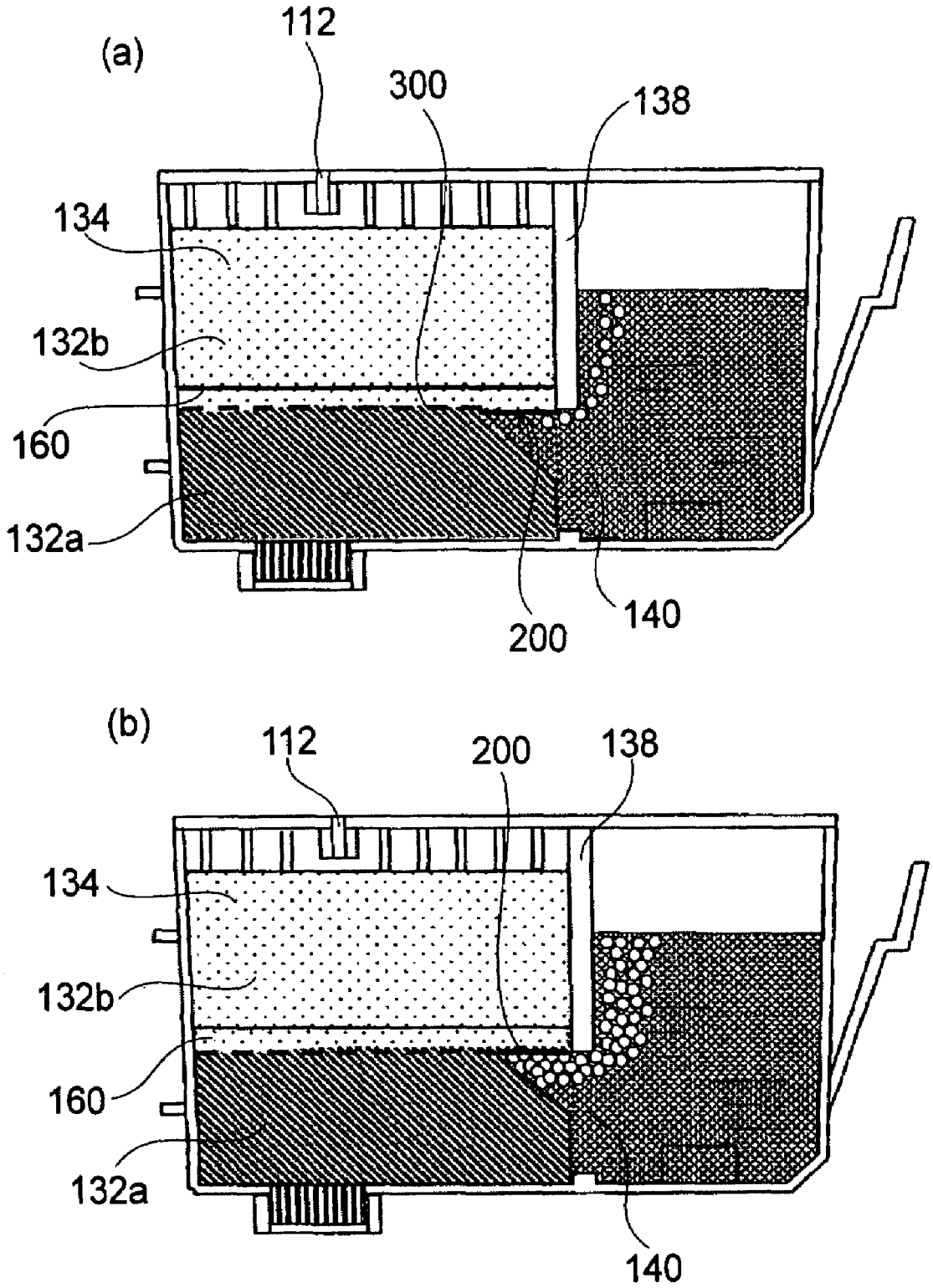
FIG. 7 is a schematic sectional view of a liquid container according to a fourth embodiment of the present invention, wherein (a) illustrates a state in which the amount of the ink consumption per unit time is relatively small, and (b) illustrates a state in which the amount of the ink consumption per unit time is relatively large.

FIG. 7 is a schematic sectional view of a liquid container according to a fourth embodiment of the present invention, wherein (a) illustrates a state in which the amount of the ink consumption per unit time is relatively small, and (b) illustrates a state in which the amount of the ink consumption per unit time is relatively large.

The basic structures and operations are similar to those in first embodiment, and therefore, the detailed description of the common parts is omitted for simplicity.

What is different from the first embodiment is in that negative pressure producing member is divided into two parts.

The negative pressure producing member accommodating chamber 134 accommodates first and second negative pressure producing members 132*a* and 132*b* which are press-contacted to each other. The capillary force of the first negative pressure producing member 132*a* is higher than that of the second negative pressure producing member 132*b*. The interface in the press-contact portion 160 between the first and the second negative pressure producing members 132*a* and 132*b* extends in the direction crossing with the partition wall 138. The first negative pressure producing member 132*a* is in fluid communication with the communicating portion 140, and is communicable with the air vent 112 only through the interface in the press-contact portion 160. The second negative pressure producing member 132*b* is communicable with the communicating portion 140 only through the interface in the press-contact portion 160. The gas introduction surface 200 is disposed at a position below the interface in the press-contact portion 160 between the two negative pressure producing members.

With this structure, the capillary force of the first negative pressure producing member 132*a* is higher than the capillary force of the second negative pressure producing member 132*b*, and therefore, during the lowering of the gas-liquid interface in the negative pressure producing member with the consumption of the ink, it is assured that ink retained in the first negative pressure producing member 132*a* is consumed only after the ink retained in the second negative pressure producing member 132*b* thereabove is consumed. For this reason, only after the gas-liquid interface becomes once substantially horizontal at the interface in the press-contact portion 160 between the first negative pressure producing member 132*a* and the second negative pressure producing member 132*b*, the gas-liquid interface lowers to the position of the gas introduction surface 200, so that gas-liquid interface upon the beginning of the gas-liquid exchange is more assuredly horizontal, as desired, as indicated by the gas-liquid interface 300 (broken line) as compared with the foregoing embodiments. In addition, during transportation of the ink cartridge wherein the orientation of the ink cartridge is not controllable, the ink leakage can be avoided, thus improving the reliability. This may be combined with any of the foregoing embodiments.

The ink is filled such that it exists above the recess (gas introduction surface) further to the entirety of the interface between the first negative pressure producing member 132*a* and the second negative pressure producing member 132*b*, and this is desirable. During the transportation process after the manufacturing of the ink reservoir and before the start of the use, the air adjacent the air vent 112 may enter the ink reservoir chamber 136 through the negative pressure producing member 132*a* or 132*b*, and correspondingly, the ink may discharge into the air vent portion. By the filling so as to retain the ink at the interface, such a problem can be avoided.

Other Embodiments

In the first, second and third embodiments of the present invention, a gap may occur between surface portion of the inner wall of the negative pressure producing member accommodating chamber and the surface portion of the negative pressure producing member, and the air enters the gap with the result of unintended gas-liquid exchanging operation. The description will be made as to this.

Such a gap results by yielding of a part of negative pressure producing member. This will be called "wall surface path".

Figure 8:
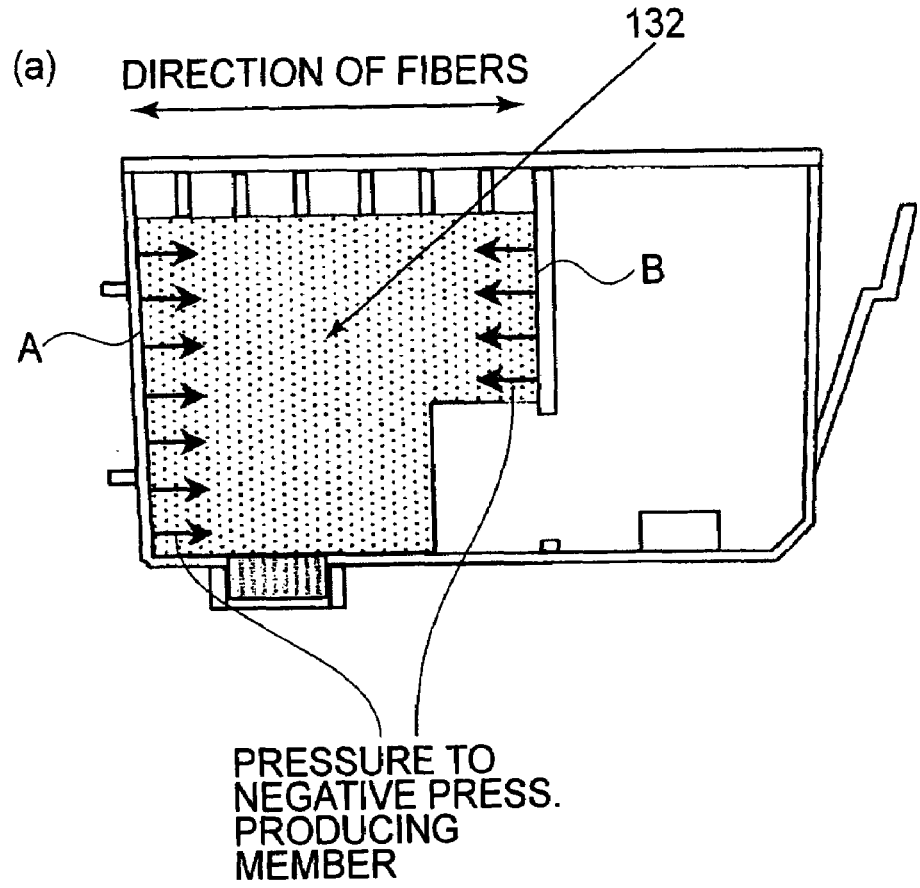
FIG. 8 is a schematic sectional view of the liquid container according to an embodiment of the present invention and illustrates a problem of yielding of a negative pressure producing member when the negative pressure producing member is accommodated in the negative pressure producing member accommodating chamber.
Figure 8:
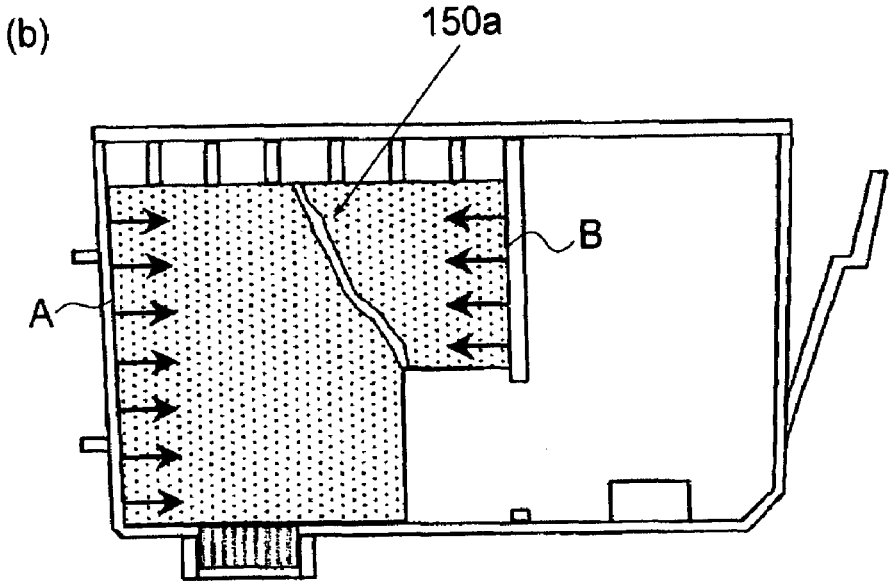

Referring to FIG. 8, the description will be made as to such a gap.

FIG. 8, (a) is a schematic sectional view of the container in which the negative pressure producing member 132 is accommodated in the negative pressure producing member accommodating chamber. At this time of setting the negative pressure producing member 132 in the negative pressure producing member accommodating chamber, it is desirable that no gap is formed between the negative pressure producing member 132 and the inner wall of the negative pressure producing member accommodating chamber, and that is contacted to the inner wall of the negative pressure producing member accommodating chamber in a proper state, from the standpoint of prevention of ink leakage or the like. Therefore, it is desirable that sizes of the negative pressure producing member before it is accommodated in the negative pressure producing member accommodating chamber are larger than the corresponding inner sizes of the negative pressure producing member accommodating chamber.

However, as described hereinbefore, in the case that sizes of the negative pressure producing member are larger than the sizes of the negative pressure producing member accommodating chamber, the negative pressure producing member is subjected to forces tending to compress the negative pressure producing member from the inner wall of the negative pressure producing member accommodating chamber. The compression forces are applied from the negative pressure producing member accommodating chamber on a surface A and a surface B of the negative pressure producing member 132 as shown in FIG. 8. If the stress caused in the negative pressure producing member 132 is concentrated at a part (where the configuration of the cross-section of the negative pressure producing member changes drastically), the negative pressure producing member, there occurs a portion where the negative pressure producing member 132 deforms inwardly at the stress-concentrated position (the deformation is a dimple 150*b* resulting from yielding 150*a*).

The yielding 150*a* leads to production of the above-described wall surface path, with the result that ink existing in the space formed by the cut-away portion of the negative pressure producing member may be easily brought into fluid communication with the ambient air. If this occurs, the ink may leak from the liquid container.

In consideration of such a problem, it is desirable to provide an ink container with which the gas-liquid exchanging operation is stable even when the dimple 150*b* is produced by the yielding 150*a*.

An example of solving the problem will be described.

Figure 9:
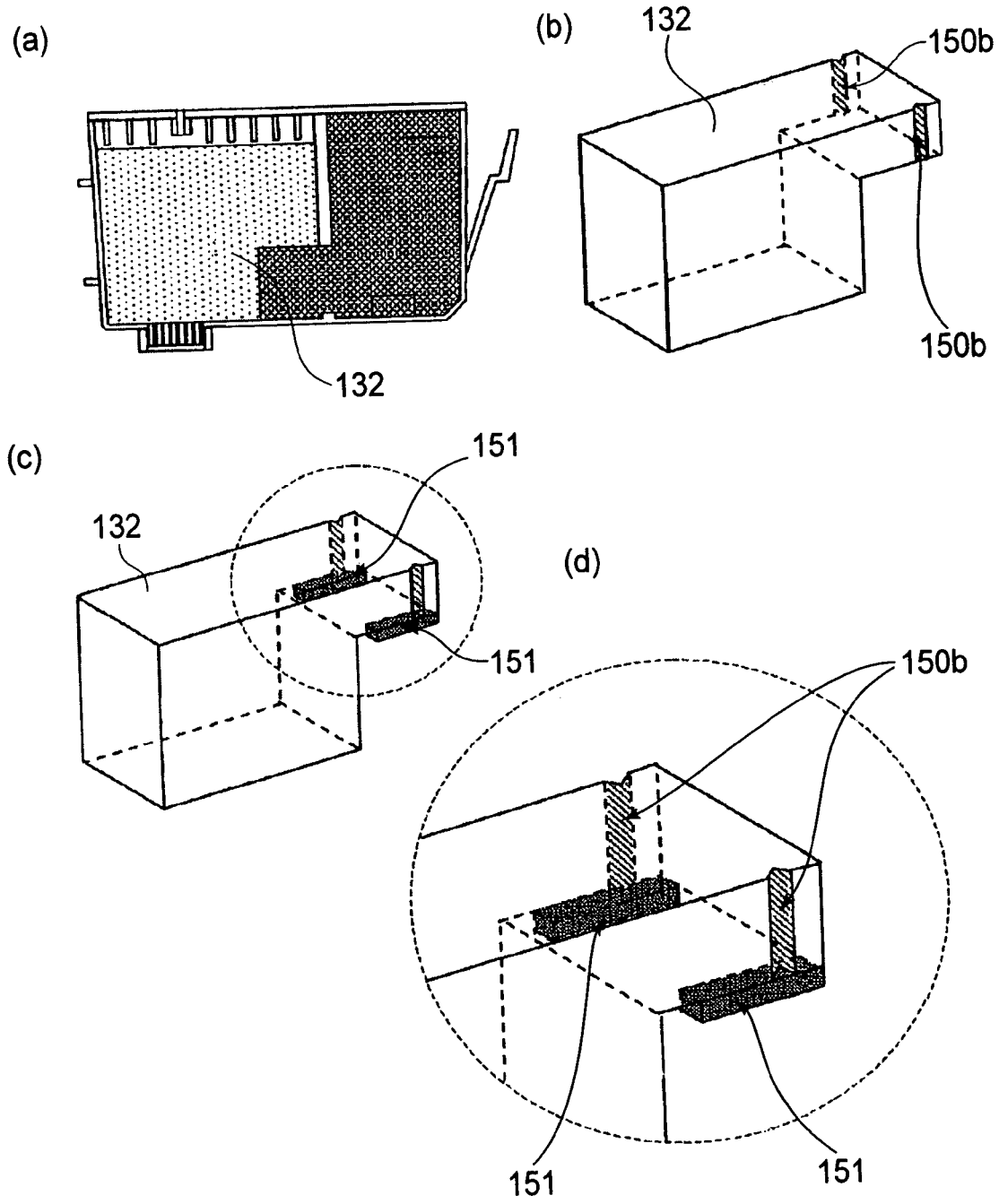
FIG. 9 is an enlarged schematic view of a liquid container according to the second embodiment, as an example, to illustrate a counter measurement for preventing wall surface path.

FIG. 9, (a) is a schematic sectional view of an ink cartridge of the second embodiment wherein the means for solving the problem is incorporated. The negative pressure producing member 132 of the second embodiment is accommodated in the negative pressure producing member accommodating chamber. FIG. 9, (b) is a substantial perspective view of the negative pressure producing member only, which is used in FIG. 9, (a) and has a dimple 150*b* on the surface of the negative pressure producing member as shown.

A side wall of the projection 151 which is formed so as to be in close contact with the inner wall of the negative pressure producing member accommodating chamber, is disposed at an end of the gap produced at the dimple 150*b* of the surface of the negative pressure producing member and the inner wall of the negative pressure producing member accommodating chamber corresponding thereto, as shown in FIG. 9, (c). By doing so, the ink existing in such a space is blocked from flowing into the gap, by which the communication between the ambient air and the ink existing in the space can be prevented.

FIG. 9, (d) is a substantial enlarged view illustrating a relation between the gap existing between the surface of the negative pressure producing member and the internal wall surface and the projection 151 formed close-contacted to the inner wall of the negative pressure producing member accommodating chamber, wherein the projection 151 formed close-contacted to the inner wall of the negative pressure producing member accommodating chamber is close-contacted to the end of the gap formed between the surface of the negative pressure producing member and the internal wall surface.

In the case that there is a liability of production of the gap by which the ink existing in the space formed by the cut-away portion of the negative pressure producing member becomes in fluid communication with the ambient air with the result of unintended gas-liquid exchanging operation, the projection formed close-contacted to the inner wall of the negative pressure producing member accommodating chamber is close-contacted to the end of the gap produced on the surface of the negative pressure producing member so that communication between the ambient air and the ink existing in the space formed by the cut-away portion of the negative pressure producing member, occurrence of the wall surface path is prevented. Thus, the ink leakage caused by the gap due to the yielding can be prevented.

Figure 10:
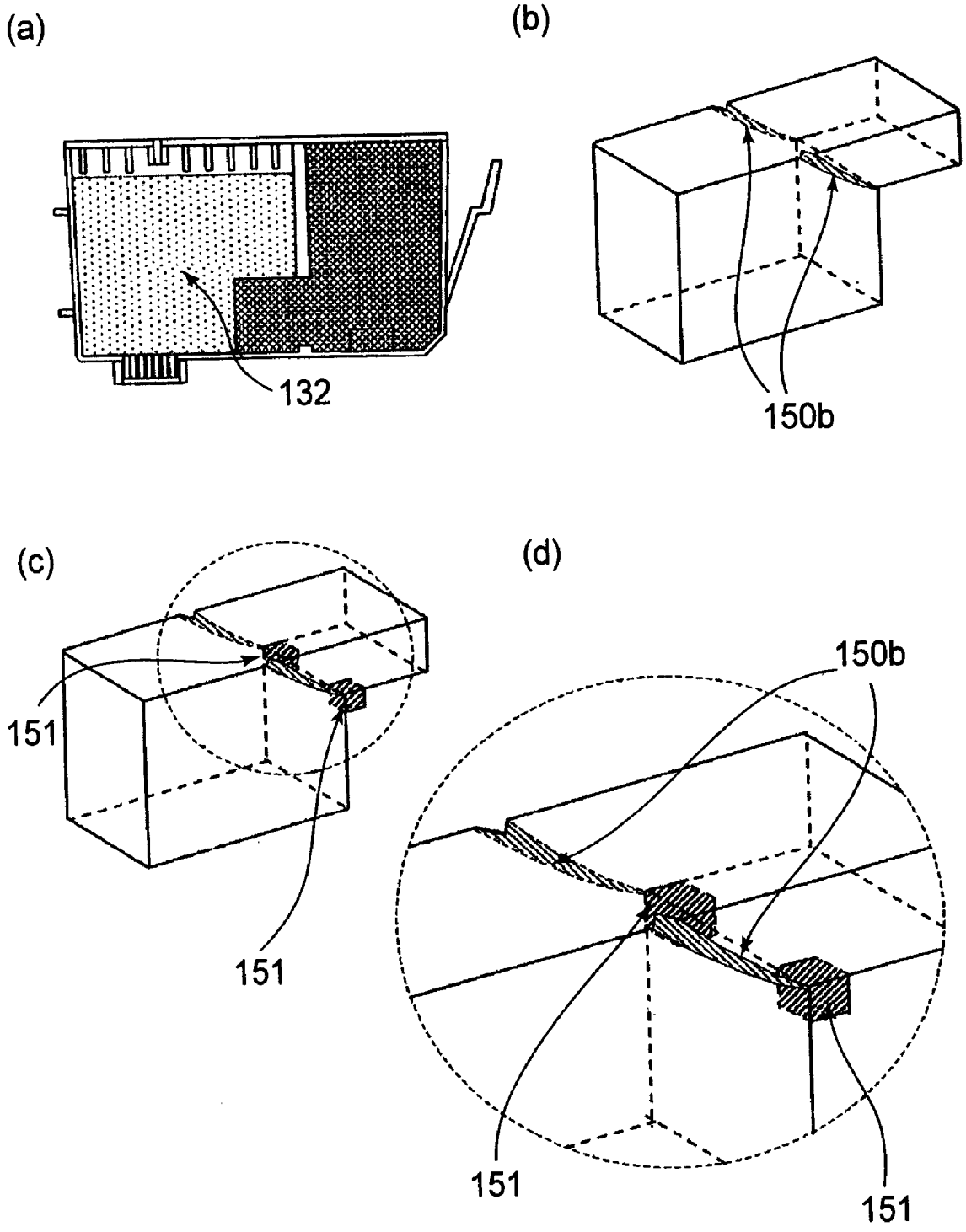
FIG. 10 is an enlarged schematic view of a liquid container according to the second embodiment, as an example, to illustrate a counter measurement for preventing wall surface path.
Figure 11:
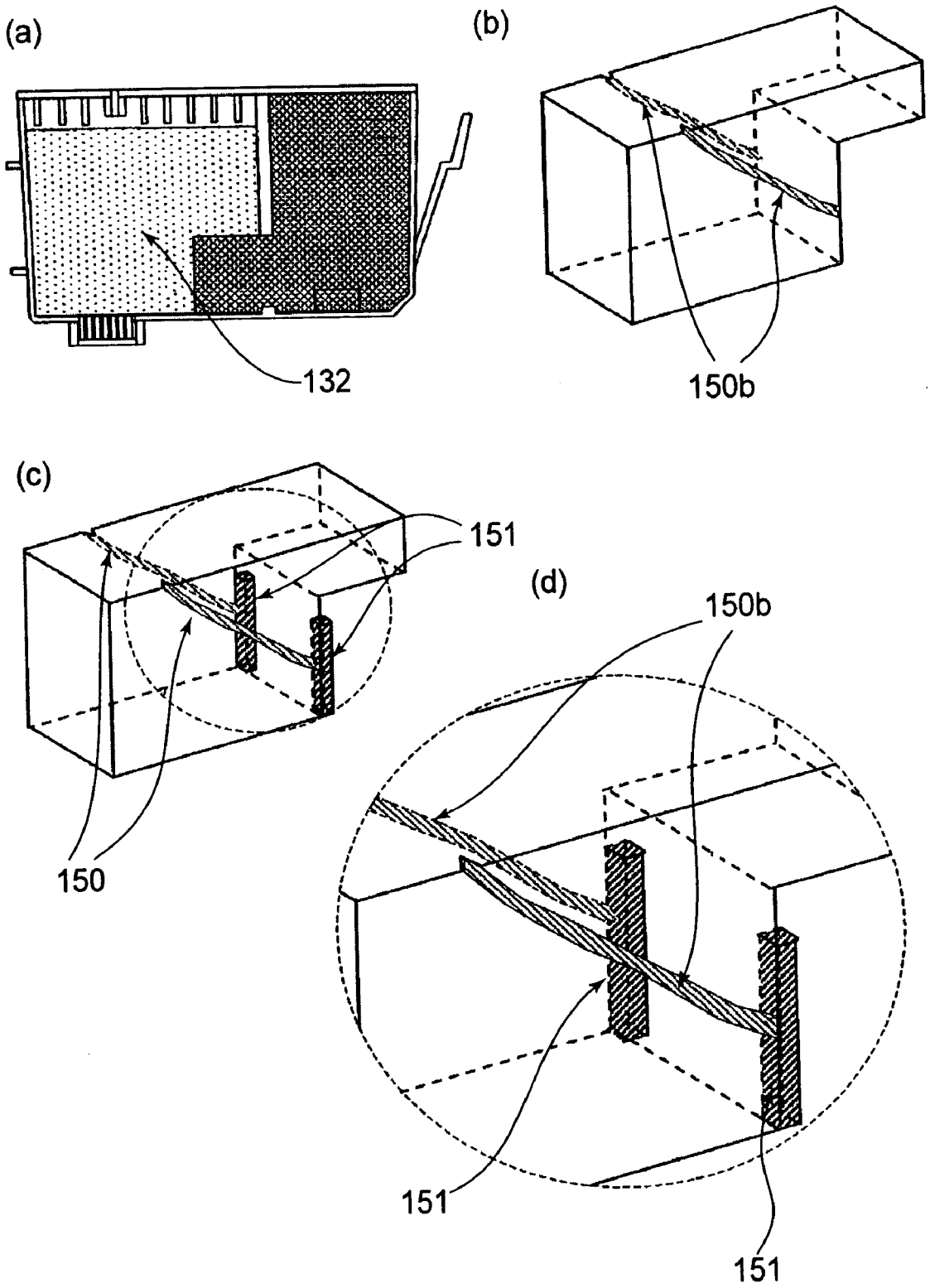
FIG. 11 is an enlarged schematic view of a liquid container according to the second embodiment, as an example, to illustrate a counter measurement for preventing wall surface path.

FIG. 10 is a schematic sectional view of an ink cartridge according to the second embodiment of the present invention wherein the problem is solved, and FIG. 11 is a schematic perspective view of the negative pressure producing member only, which is used in the negative pressure producing member accommodating chamber of the ink cartridge of FIG. 10. This embodiment is different in the position of the dimple 150*b* produced in the surface of the negative pressure producing member (gap formed with the internal wall surface).

Similarly to the example of FIG. 9, the end of the gap formed between the internal wall surface and the surface of the negative pressure producing member is sealed by the projection 151 formed close-contacted to the inner wall of the negative pressure producing member accommodating chamber so as to block the communication between the ambient air and the ink existing in the space formed by the cut-away portion of the negative pressure producing member. By doing so, production of the wall surface path and therefore the ink leakage is prevented.

As described in the foregoing referring to FIGS. 9, 10 and 11, in order to prevent the ink leakage through the air vent of the liquid container as a result of occurrence of unintended gas-liquid exchange (occurrence of the wall surface path) by fluid communication between the air in the negative pressure producing member of the portion above the desired position of the gas-liquid interface and the ink existing in the space at the negative pressure producing member side through the gap formed between the inner wall and the surface of the negative pressure producing member, the end of the gap formed between the internal wall surface and the surface of the negative pressure producing member is sealed by the projection 151 formed close-contacted to the inner wall of the negative pressure producing member accommodating chamber, by which the introduction of the air through the wall surface path into the ink existing in the space formed by the cut-away portion of the negative pressure producing member.

When the occurrence of the gap leading to the communication between the ink existing in the space at the negative pressure producing member side and the ambient air in the negative pressure producing member above the position of the desired gas-liquid interface and therefore leading to the unintended gas-liquid exchange (surface path), is predicted, the projection 151 is disposed so as to seal the end of the predicted gap. By doing so, even if the gap is produced, the establishment of the wall surface path can be prevented.

Figure 12:
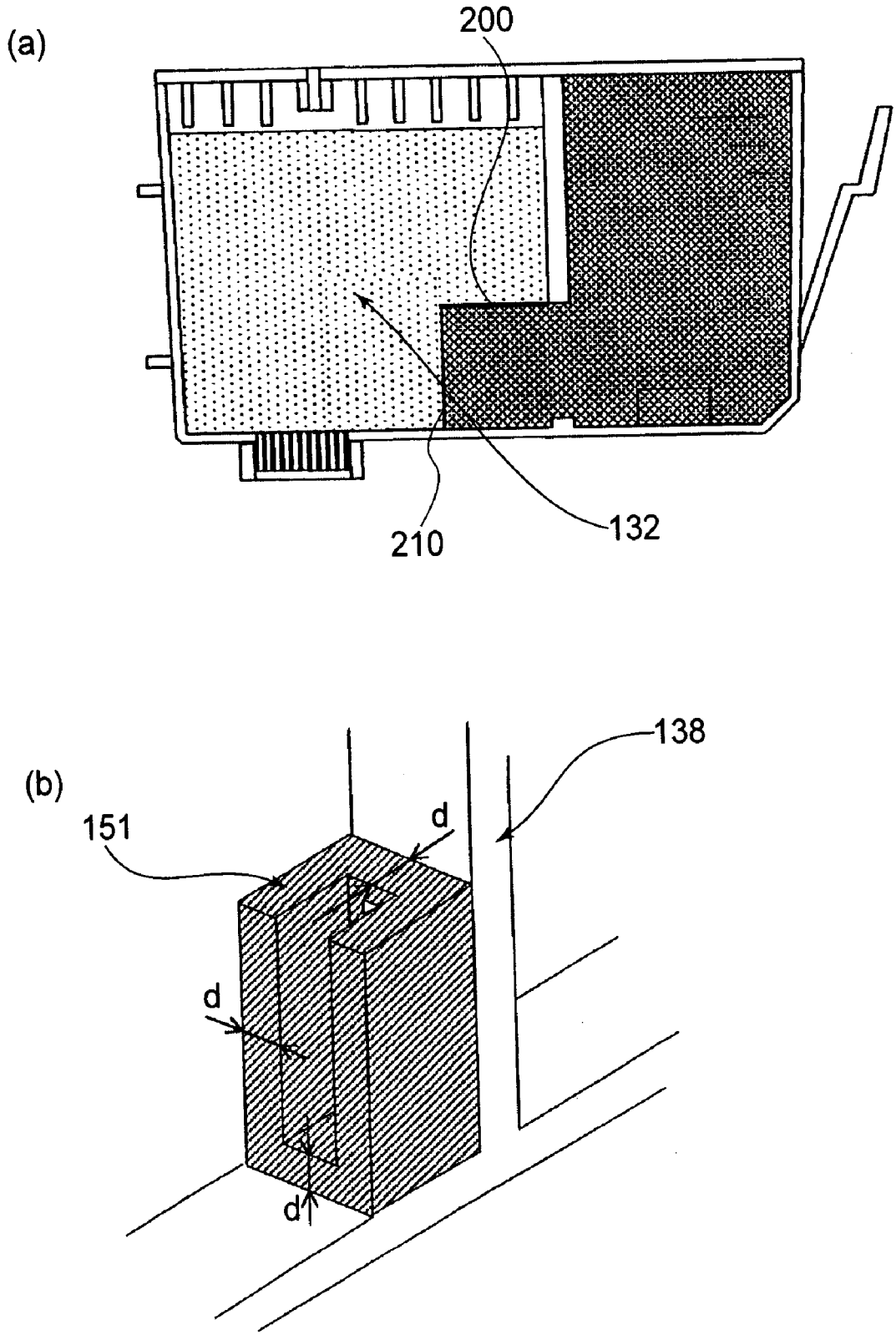
FIG. 12 is a schematic enlarged view of a liquid container according to the second embodiment, as an example, to illustrate provision of a projection as the counter measurement for preventing the wall surface path prevention.

Referring to FIG. 12, an example will be described.

As shown in FIG. 12, (a), the projection 151 is formed close-contacted to the inner wall of the negative pressure producing member accommodating chamber and is disposed, as shown in FIG. 12, (b) so as to seal the end of the predicted gap produced between the internal wall surface of the negative pressure producing member accommodating chamber and the surface of the negative pressure producing member when the negative pressure producing member 132 is partly cut away as shown in FIG. 12, (a). By doing so, the production or establishment of the wall surface path due to the dimple 150*b* can be prevented.

In the case that ink existing in the space at the negative pressure producing member side may become in fluid communication with the ambient air in the negative pressure producing member above the position of the desired gas-liquid interface with the result of unintended gas-liquid exchange, a projection 151 close-contacted to the inner wall of the negative pressure producing member accommodating chamber is formed, as shown in FIG. 12, (b), by which the influence of the dimple 150*b* is prevented. By this, even if a dimple is produced in the surface of the negative pressure producing member by yielding, the stabilized gas-liquid exchanging operation can be performed, and the ink leakage can be prevented.

Referring to FIG. 12, (b), this will be further described. The projection 151 is in the form of a frame having a thickness of d is contacted to the surfaces facing the liquid containing chamber 136, namely, to the both of the horizontal ceiling surface (gas introduction surface 200) of the cut-away portion and the perpendicular surfaces 210 of the cut-away portion.

As regards the material of the negative pressure producing member and the yielding, the dimple 150*b* and therefore the wall surface path tend to occur in the fibers of polyester, or the like, particularly in the case of the fibers having a directional feature, than in polyurethane foam, although it is dependent on the material and structure of the negative pressure producing member.

The member constituted by fibers extending in a predetermined direction may be poorer in the follow ability and isotropic property than the foam member such as urethane foam or the like, and therefore, the stress concentration tends to occur.

The description will be made as to the ink cartridge of the second embodiment wherein the negative pressure producing member is made of fibers extended unidirectionally, which is subject to the yielding.

Figure 13:
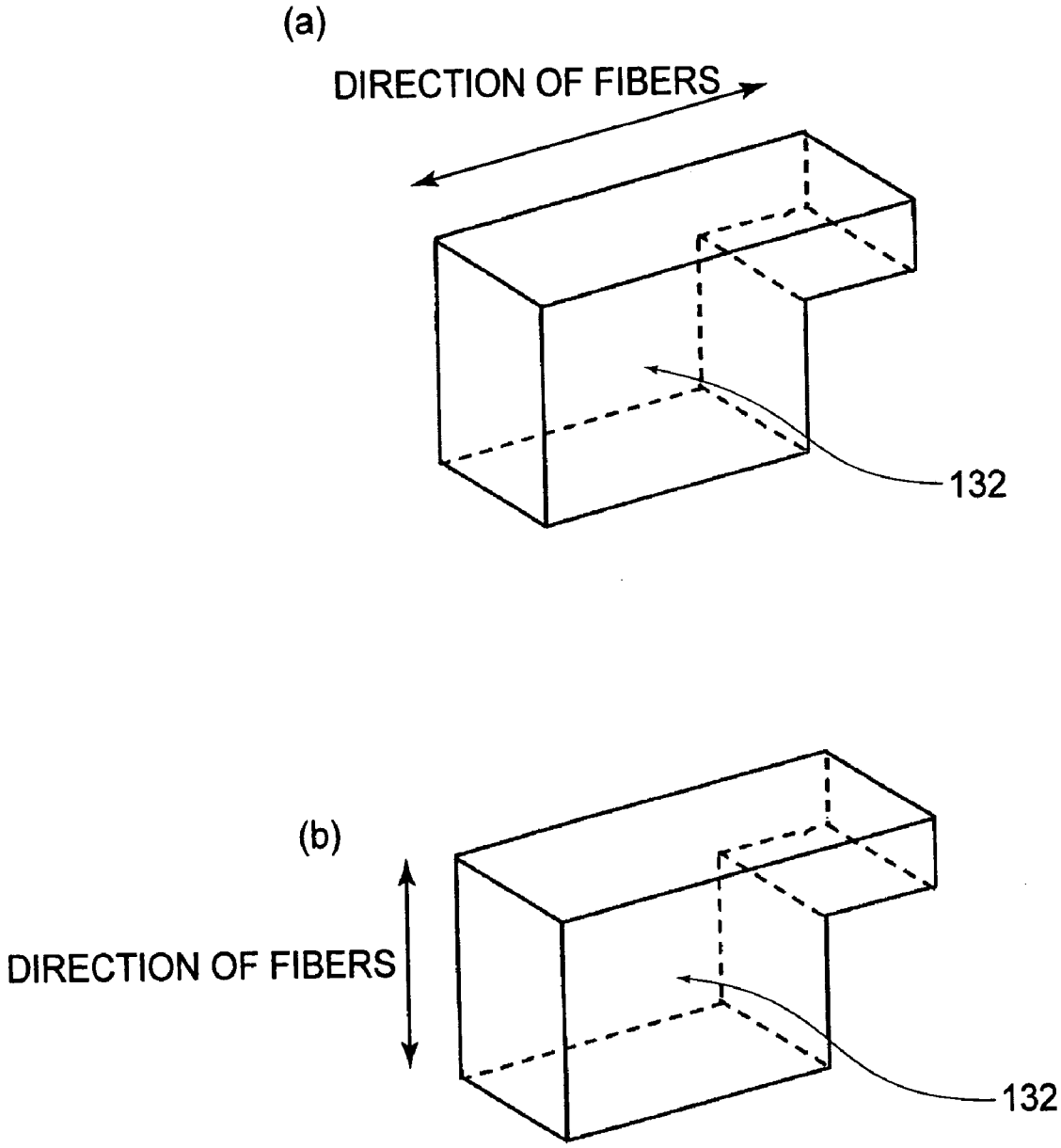
FIG. 13 is a perspective view of a negative pressure producing member used with the ink cartridge according to the second embodiment of the present invention, wherein yielding depending on the directions of the fibers constituting the negative pressure producing member.

FIG. 13, (a) and FIG. 13, (b) are perspective views of the negative pressure producing member only provided in the ink cartridge of the second embodiment.

A maximum area sides (major sides) of the liquid container are opposed to each other with respect to the direction in which the containers are arranged in use, and therefore, it is desirable that negative pressure producing member 132 accommodated therein has a flexibility against compression and a repelling elasticity in a direction perpendicular to the sides. From this standpoint, the fibers may extend in the directions shown in FIG. 13, (a) and (b).

In such cases, wherein the direction of fibers is different, the position where the yielding, namely, the dimple 150*b* tends to occur is different. Since the expansion and contraction property is relatively poor in the direction of the fibers, the dimple 150*b* tends to produce in the direction perpendicular to the direction of fibers.

For example, it is predicted that when the fiber direction is as shown in FIG. 13, (a), the dimple 150*b* shown in FIG. 9, (b) tends to result, and when the fiber direction is as shown in FIG. 13, (b), the dimple 150*b* shown in FIG. 10, (b) tends to result. In either case, the predicted yielding can be avoided by the concept described in conjunction with FIG. 12, (b). More particularly, the end of the gap 150*c* formed between the internal wall surface and the surface of the negative pressure producing member is sealed by the projection 151 formed close-contacted to the inner wall of the negative pressure producing member accommodating chamber so as to blocking the communication between the ambient air and the ink existing in the space formed by the cut-away portion of the negative pressure producing member, by which the occurrence of the wall surface path is suppressed to prevent the ink leakage attributable to the gap.

Figure 14:
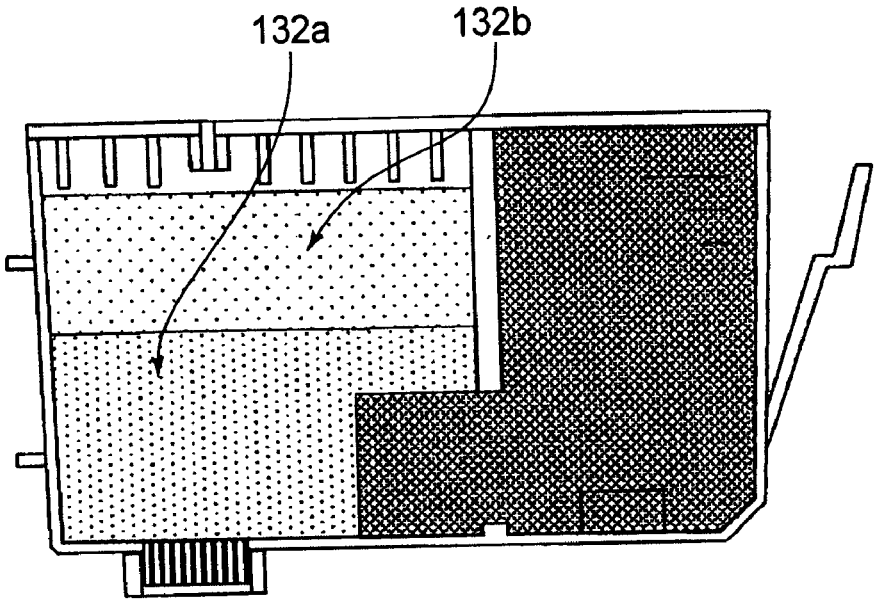
FIG. 14 is a schematic sectional view of a liquid container according to the present invention wherein (a) illustrates a state in which a first negative pressure producing member and a second negative pressure producing member are accommodated in a negative pressure producing member accommodating chamber, (b) illustrates an example of a state in which such a gap as causes fluid communication between the second negative pressure producing member and the ink existing in the space between the communicating portion and the negative pressure producing member in the liquid container.
Figure 14:
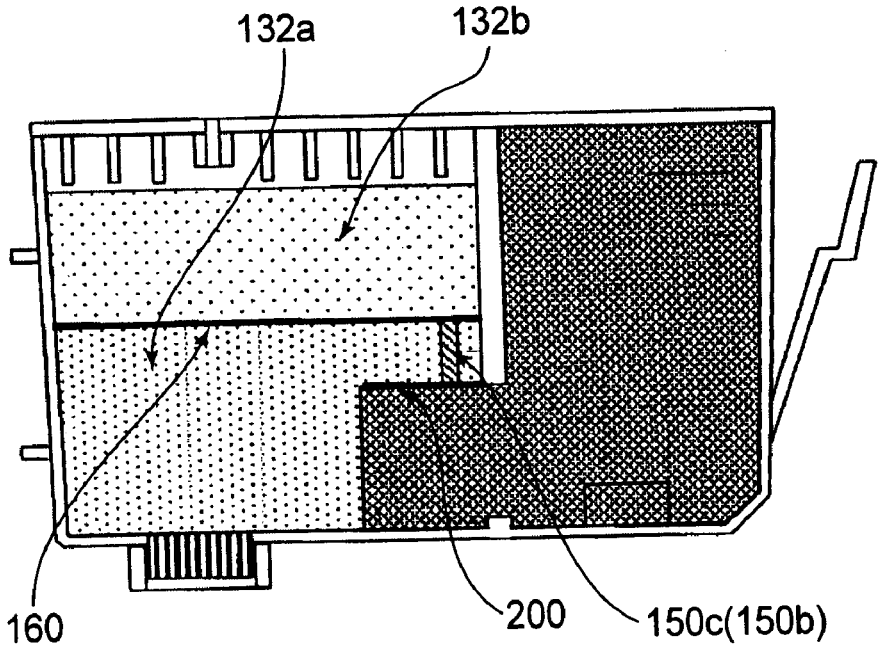

Referring to FIG. 14, the description will be made as to a fourth embodiment wherein the negative pressure producing member is divided into two portions.

FIG. 14, (a) is a schematic sectional view of an ink cartridge wherein a first negative pressure producing member 132*a* and a second negative pressure producing member 132*b* are accommodated in the negative pressure producing member accommodating chamber. FIG. 14, (b) is an example in which such a gap 150*c* (dimple 150*b*) as communicating the ink existing in the space formed by the cut-away portion with the second negative pressure producing member 132*b*, is produced.

In such a case with the two negative pressure producing members, similarly to the case of one negative pressure producing member, when a gap continuously formed in the first and second negative pressure producing members is produced to cause a fluid communication between the ink existing in the space formed by the cut-away portion of the negative pressure producing member and the ambient air, a wall surface path may occur to cause ink leakage from the liquid container. As another problem, there is a liability of production of such a gap 150*c* as to cause a fluid communication between the second negative pressure producing member 132*b* and the ink existing in the space formed by the cut-away portion of the negative pressure producing member, as shown in FIG. 14, (b).

This problem includes two aspects which tend to result when the ink is consumed to a certain extent. In the first aspect, when the air becomes present in the ink accommodating chamber by the gas-liquid exchange, the air in the ink accommodating chamber expands or contracts by changes of the ambient temperature. When this is repeated, the ink leakage may occur. The mechanism is as follows. When the ambient temperature when the ink cartridge is used, the air in the ink accommodating chamber expands, and the amount of the ink corresponding to the expansion is discharged into the negative pressure producing member accommodating chamber. If the first negative pressure producing member 132*a* has the dimple 150*b* as shown in FIG. 14, (b), a part of the ink discharged from the ink accommodating chamber is moved through the gap 150*c* formed by the internal wall surface and the dimple 150*b* and is absorbed in the second negative pressure producing member 132*b*. If the ambient temperature lowers then during the use of the ink cartridge, the air in the ink accommodating chamber contracts, the ink accommodating chamber tends to suck the amount of the ink absorbed in the negative pressure producing member corresponding to the volume of contraction back into the ink accommodating chamber. In this occasion, the flow resistance in sucking the air in the negative pressure producing member is smaller than the flow resistance in sucking the ink in the negative pressure producing member, with the result that air is also sucked together with the ink back into the ink accommodating chamber from the negative pressure producing member. If the expansion and the contraction are repeated, the amount of the ink corresponding to the sucked-back air remains in the negative pressure producing member accommodating chamber, so that amount of the ink retained in the negative pressure producing member accommodating chamber gradually increases to such an extent the ink leaks out.

Another aspect relates to the existence of the gap 150*c* in the second negative pressure producing member 132*b* as shown in FIG. 14, (b). In such a case, the gas-liquid exchange starts between the gap 150*c* and the interface of the press-contact portion 160 of the first and second negative pressure producing members before the gas-liquid interface lowers to the gas introduction surface 200. In other words, the gas-liquid exchanging operation starts as if the position of the gas introduction surface 200 were set at the position of the press-contact portion 160. As a result, when the emptiness of the ink cartridge is detected, the amount of the ink still retained in the negative pressure producing member 132*a* is larger than expected, so that ink remainder at the end of the service life of the ink container is larger than the normal remainder.

As regards the amount of the gas introduction through the gap 150*c*, since the gas-liquid exchange may be insufficient under the large ink supply flow rate (per unit time), the gas-liquid interface temporarily lowers, but after the ink supply stops, the air is introduced into the liquid containing chamber through the 150*c*. Correspondingly, the ink moves into the negative pressure producing member, and the ink interface rises up to the interface of the press-contact portion 160 which is the top end portion of the gap 150*c*, and therefore, the ink remainder at the end of the life is larger, irrespective of the ink supply rate.

As described in the foregoing with respect to fourth embodiment, the second negative pressure producing member 132*b* is supposed to be in fluid communication with the ink existing in the space formed by the cut-away portion of the negative pressure producing member only through the press-contact portion relative to the first negative pressure producing member 132*a*. Therefore, in such a case, the adverse influence of the yielding if any can be avoided by sealing the end of the gap 150*c* by the projection 151 formed close-contacted to the inner wall of the negative pressure producing member accommodating chamber so as to block the fluid communication between the second negative pressure producing member and the ink existing in the space formed by the cut-away portion of the negative pressure producing member.

The projection provided to prevent occurrence of the wall surface path provides a secondary effect, that is, by the projection contacting the surface of the cut-away portion of the negative pressure producing member accommodated in the negative pressure producing member accommodating chamber, the area of the negative pressure producing member which receives the compressive force (cause of the yielding) from the internal wall surface, the yielding per se is suppressed. When the negative pressure producing member is made of fibers with the directionality, for example, the surface of the cut-away portion which is substantially perpendicular to the direction of the fibers works effectively.

As regards the sealing of the end of the gap in the surface of the negative pressure producing member by the projection 151 formed close-contacted to the inner wall of the negative pressure producing member accommodating chamber, the occurrence of the wall surface path can be prevented irrespective of the sealing position of the extending gap. However, the sealing at one or both of the gaps is preferable since it is simple.

The projection 151 may be integrally molded with the liquid container, or may be formed as a separate member and bonded to the liquid container, for example.

The first to fourth embodiments of the present invention may be incorporated with the structure described here, that is, the structure in which the end of the gap produced in the surface of the negative pressure producing member is sealed, and the projection is formed close-contacted to the inner wall of the negative pressure producing member accommodating chamber so as to block introduction of the air into the ink existing in the space formed by the cut-away portion of the negative pressure producing member.

The description has been made as to the solution to the occurrence of the wall surface path with respect to the first to fourth embodiments. The description will be made as to the occurrence of a path at an apex line portion.

Figure 15:
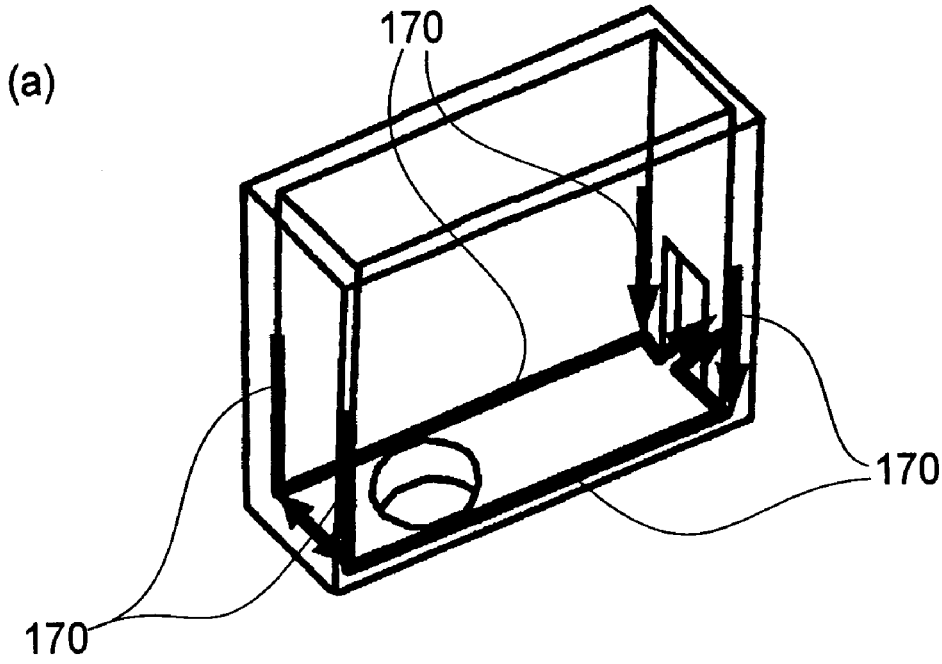
FIG. 15 illustrates occurrence of an apex line path in the liquid container according to the present invention, wherein (a) shows the position where the edge line path is produced in the negative pressure producing member accommodating chamber, and, (b) shows an example of the edge line path produced when the negative pressure producing member is inserted.
Figure 15:
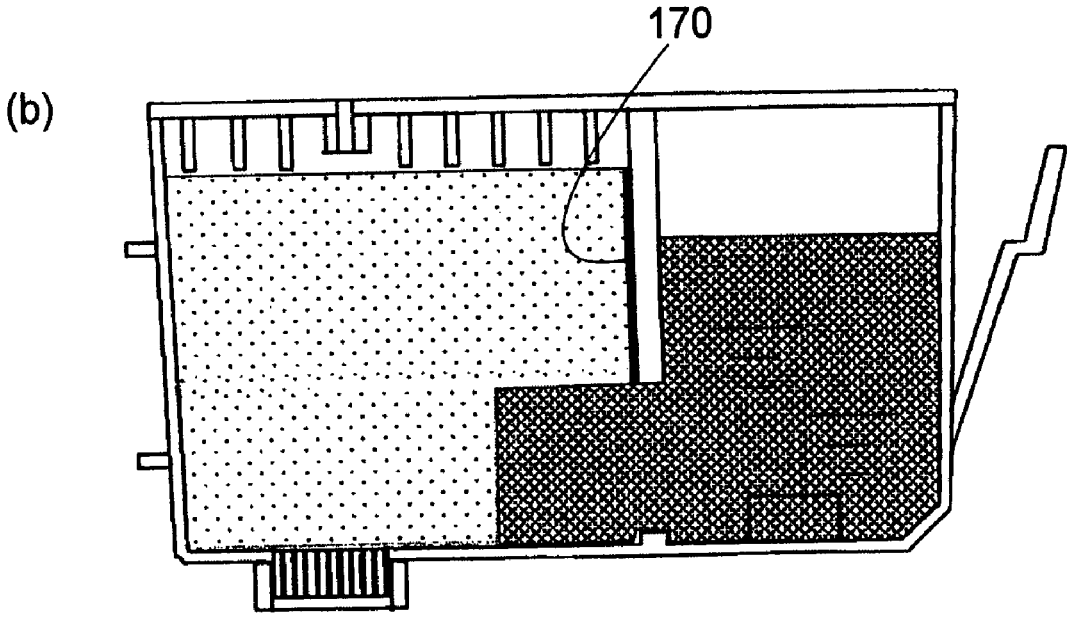

First, the apex line path will be described. A gap may be produce between an apex line of the inner wall of the negative pressure producing member accommodating chamber and the corresponding portion of the negative pressure producing member. If the air enters into such a gap, an unintended gas-liquid exchanging operation may occur through the gap (path). This is called "apex line path" FIG. 15, (b) shows the occurrence of the apex line path in the ink container according to the second embodiment, wherein the gap 170 is produced at the apex line portion of a part (side surface) of the negative pressure producing member, as is shown also in FIG. 15, (a). This defect may appear in the case that when the negative pressure producing member is inserted into the negative pressure producing member accommodating chamber, for example, the negative pressure producing member is not properly contacted to the apex line portion of the inner wall. If the apex line path is brought into fluid communication with the ambient air through the communicating portion, an unintended gas-liquid exchange occurs with the result of leakage of the ink from the liquid container. FIG. 15, (a) is a schematic view illustrating the apex line path.

Figure 16:
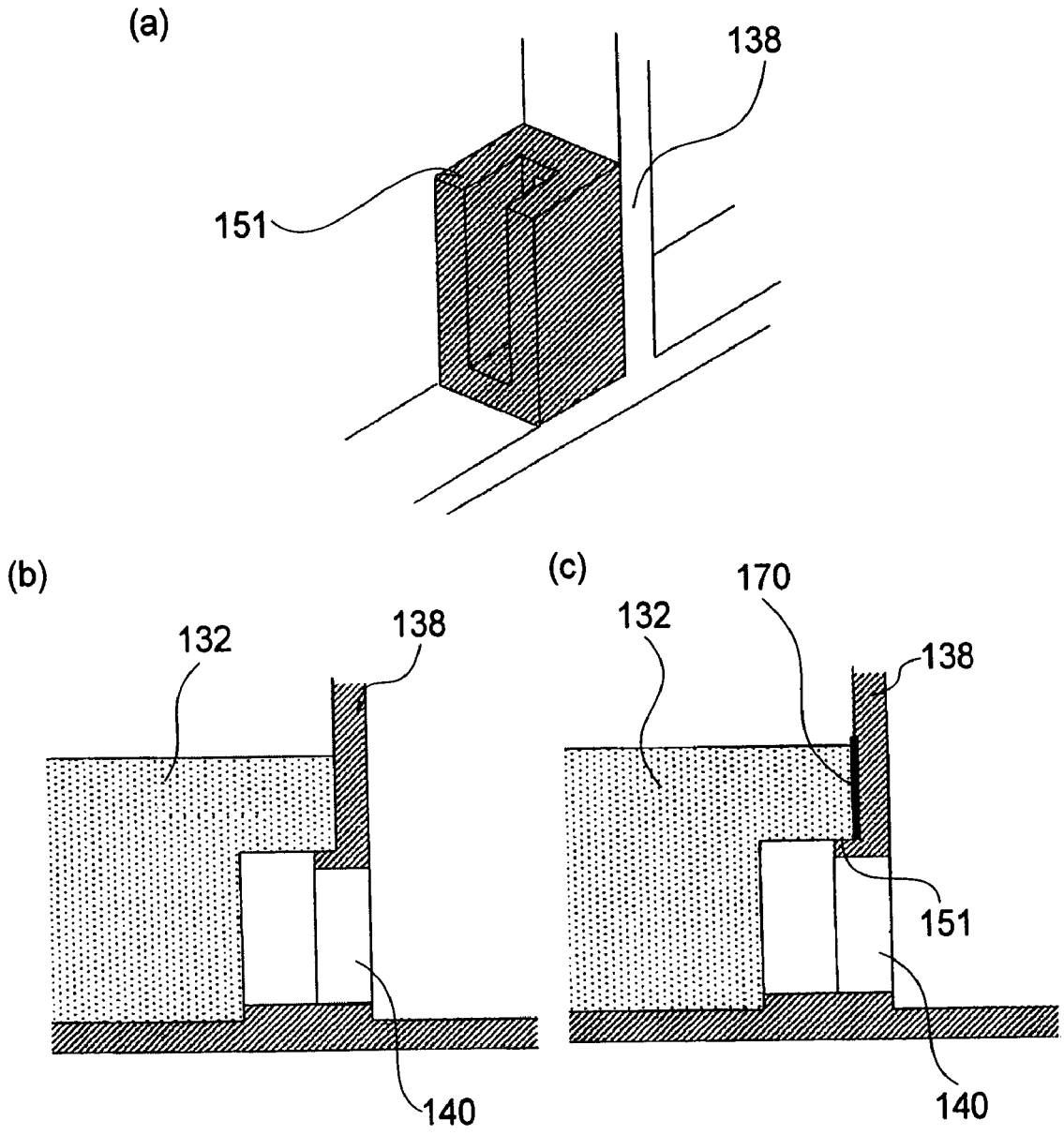
FIG. 16 is a schematic enlarged view of a neighborhood of a communicating portion of the liquid container when a projection is formed to prevent occurrence of edge line path, wherein (b) is a schematic enlarged sectional view of the neighborhood of the communicating portion as seen from the lateral side, and (c) shows a state in which an edge line path is produced at the edge line portion between the negative pressure producing member and the inner wall forming the negative pressure producing member chamber when the negative pressure producing member is inserted.

FIG. 16 is a schematic enlarged view of a neighborhood of a communicating portion of a liquid container wherein a projection is formed to match the configuration of the cut-away portion of the negative pressure producing member which projection is formed in order to prevent the apex line path. In this Figure, (a) is a schematic enlarged perspective view of the neighborhood of the communicating portion as seen from the negative pressure producing member accommodating chamber; (b) is a schematic enlarged sectional view of the neighborhood of the communicating portion as seen from a lateral side; and (c) illustrates the state in which the gap (apex line path) is produced at the apex line portion formed between the inner wall of the negative pressure producing member chamber and the negative pressure producing member when the negative pressure producing member is inserted into the negative pressure producing member chamber, for example.

In FIG. 16, (a), the liquid containing chamber is provided at a righthand side of the partition wall 138, and the negative pressure producing member accommodating chamber is formed with the partition wall 138 therebetween. A projection 151 is provided so as to contact the apex line portion formed between the surface constituting the gas introduction surface and the inner wall connecting thereto and also the apex line portion formed between the surface constituting the communication surface and the inner wall connecting thereto.

When the negative pressure producing member 132 is inserted into the negative pressure producing member accommodating chamber having such a structure, the situation becomes as shown in FIG. 16, (b) (ideal situation). However, when the negative pressure producing member is not properly inserted, the apex line path 170 is produced as shown in FIG. 16, (c). By the formation of the projection 151 shown in FIG. 16, (a), however, even if the apex line path 150 shown in FIG. 16, (c) is produced, the negative pressure producing member is contacted to the projection 151 to seal the neighborhood (hatched portion in FIG. 17) of the circumference of the cut-away portion, so that ink existing in the space formed by the cut-away portion of the negative pressure producing member is prevented from fluid communication with the apex line path.

In this description, only the lateral side of the negative pressure producing member has been dealt with, but the same applies to the bottom surface of the negative pressure producing member.

Figure 17:
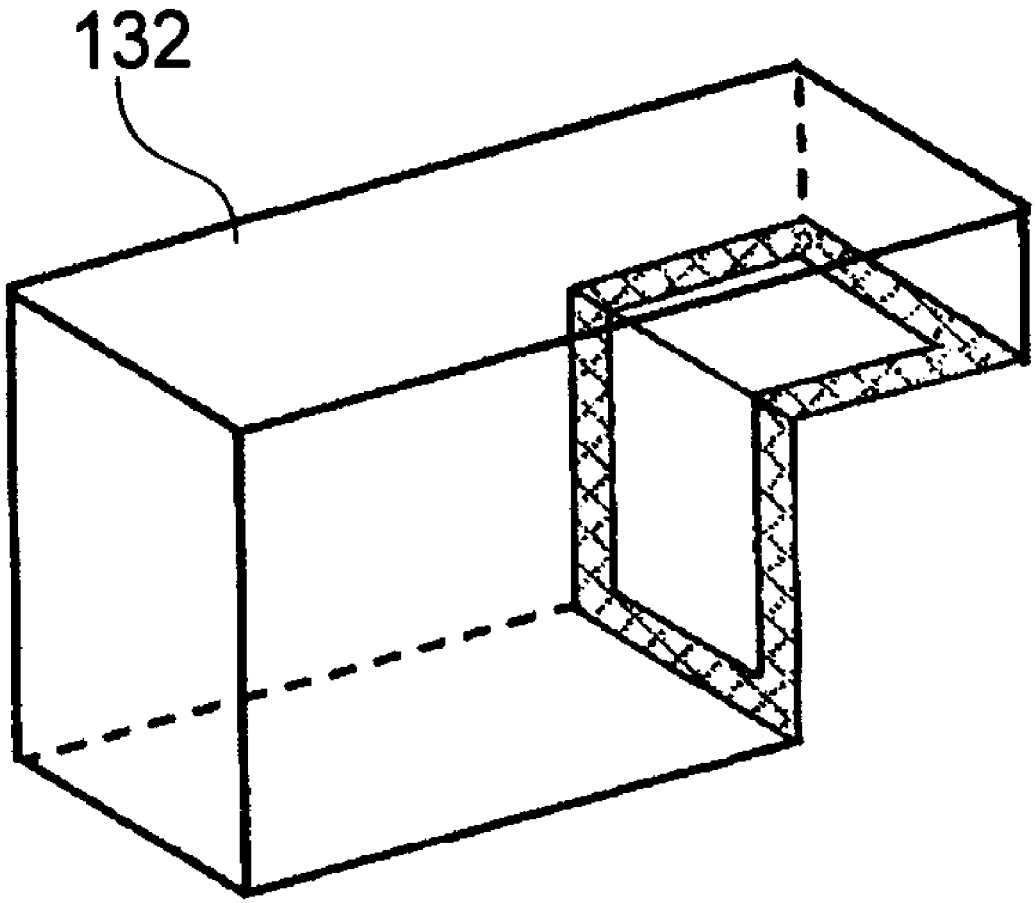
FIG. 17 is a perspective view of a negative pressure producing member usable with the embodiment of FIG. 16.
Figure 18:
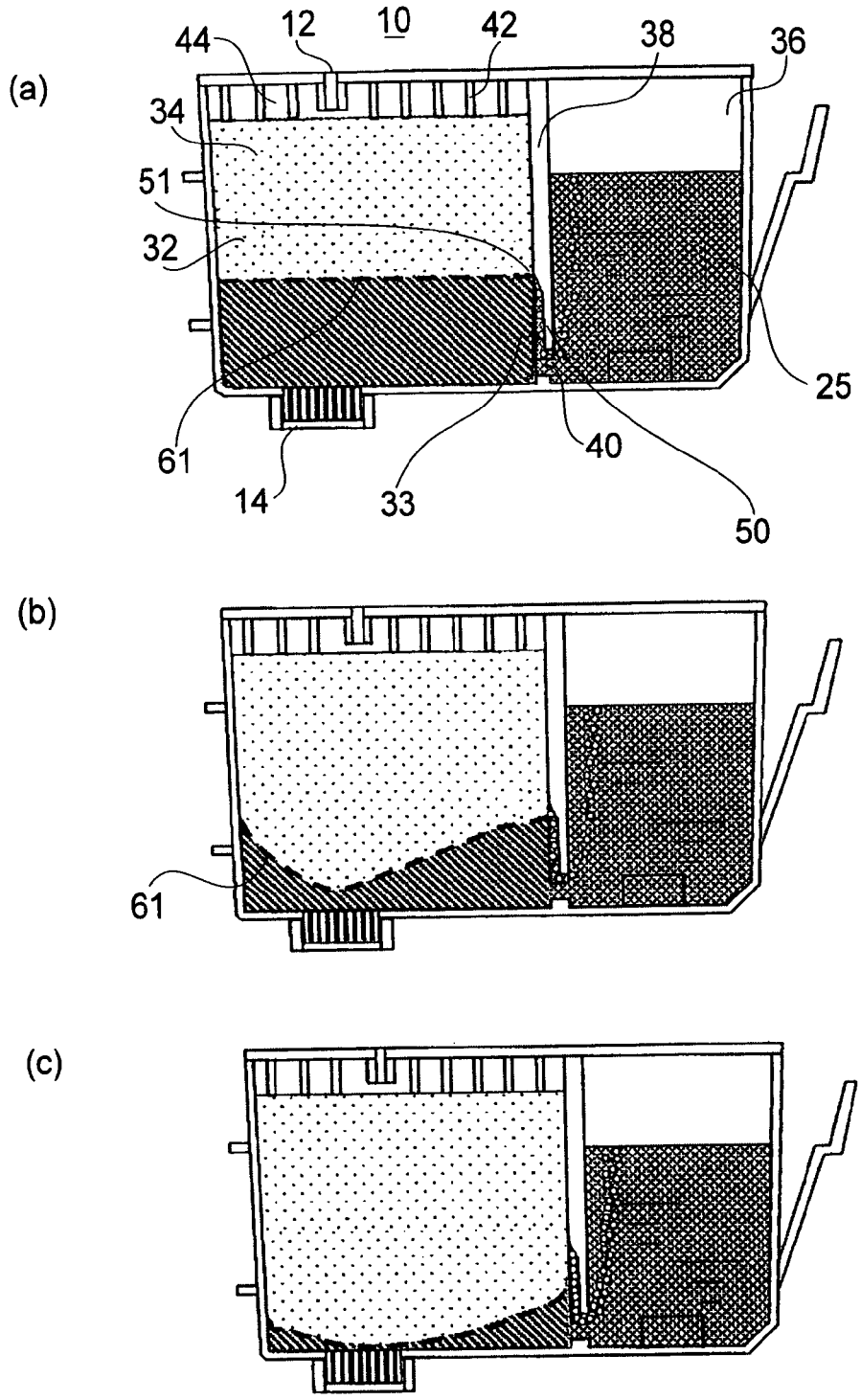
PRIOR ART FIG.18
FIG. 18 is a sectional view illustrating a problem with a conventional liquid container.

In summary, as shown in FIG. 17, the end and the neighborhood (hatched portion) of the surface of the negative pressure producing member having the cut-away portion can be sealed, and even if the apex line path is produced, the projection formed is effective to prevent the fluid communication with the ink existing in the space of the cut-away portion of the negative pressure producing member.

With such a structure, even when an air path were produced at the apex line portion between the negative pressure producing member and the inner wall constituting the negative pressure producing member chamber, the ink existing in the space of the cut-away portion of the negative pressure producing member is prevented from fluid communication with the ambient air. By this, unintended gas-liquid exchanging operation can be avoided, and in addition, the ink leakage from the liquid container can be prevented.

The projection may be integrally molded with the liquid container, or may be a separate member which may be mounted to the liquid container by bonding, for example.

Any of the foregoing embodiments may incorporate the structure described here for prevention of the apex line path (the projection is formed so as to contact the negative pressure producing member so as to match the configuration of the cut-away portion of the negative pressure producing member).

As described in the foregoing, according to the embodiments of the present invention, the negative pressure producing member 132 is provided with a cut-away portion corresponding to the communicating portion 140, and the ceiling portion of the space defined by the cut-away portion is substantially horizontal (when the ink container is set in the recording apparatus, for example, for operation) and functions as a gas-liquid introduction surface 200. By doing so, the gas-liquid introduction surface 200 is substantially parallel with the gas-liquid interface 161 in the negative pressure producing member immediately before start of the gas-liquid exchange. Even in the case that ink supply per unit time to the ink jet recording head is large, the gas-liquid interface 161 in the negative pressure producing member 132 drastically expand upon arrival of the gas-liquid interface 161 at the gas introduction surface 200 to assure the wide gas introduction portion. Therefore, the amount of the air meeting the ink discharge can be speedily introduced into the ink accommodating chamber 136, so that gas-liquid interface 161 in the negative pressure producing member 132 does not improperly lower, and therefore, the ink supply is stabilized without conventional ink disconnection. By this, a highly reliable ink cartridge and ink jet recording apparatus suitable for high speed operation can be provided.

The negative pressure producing member accommodating chamber 134 preferably accommodate first and second negative pressure producing members 132*a* and 132*b* which are press-contacted to each other, and the gas introduction surface 200 is disposed below the interface of the press-contact portion 160 between the two negative pressure producing members. With such a structure, in addition to the above-described advantageous effects, the gas-liquid interface in the negative pressure producing member is once reset by the interface in the press-contact portion 160 between the two negative pressure producing members, so that position of the gas-liquid interface upon the start of the gas-liquid exchange is stabilized, that is, the variation of the position of the gas-liquid interface is minimized, thus stabilizing the absolute value of the negative pressure during the gas-liquid exchange period.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 173472/2004 filed Jun. 11, 2004 which is hereby incorporated by reference.

What is claimed is:

1. A liquid container comprising:

a negative pressure producing member accommodating chamber accommodating a negative pressure producing member for absorbing and retaining the liquid, said negative pressure producing member accommodating chamber having a supply port for supplying the liquid to a liquid ejection recording head and an air vent for fluid communication with ambient air, wherein said negative pressure producing member covers an entirety of said supply port;

a liquid containing chamber for containing the liquid, said liquid containing chamber being in fluid communication with said negative pressure producing member accommodating chamber through a communicating portion and being substantially sealed except for said communicating portion; and a partition wall for partitioning said liquid container into said negative pressure producing member accommodating chamber and said liquid containing chamber except for said communicating portion;

wherein liquid is supplied to said liquid jet recording head through said supply port in an orientation where said supply port faces downward with respect to a direction of gravity when said liquid container is in an in-use orientation, wherein said negative pressure producing member is provided with a recess at a position corresponding to said communicating portion, the recess forming a space; and wherein a ceiling portion of the space provided by said recess functions as a gas introduction surface which is substantially horizontal in said in-use orientation, and wherein said ceiling portion extends horizontally from said communicating portion for a horizontal distance in a direction away from said supply port such that said gas introduction surface is wide.

2. A liquid container according to claim 1, wherein said negative pressure producing member includes a first and second negative pressure producing members which are press contacted to each other; a capillary force of said first negative pressure producing member is higher than a capillary force of said second negative pressure producing member; an interface of a press contact portion between said first and second negative pressure producing members crosses with said partition wall; said first negative pressure producing member is in fluid communication with said communicating portion and with said supply port; and the interface of the press contact portion between said first and second negative pressure producing members is disposed above said gas introduction surface.

3. A liquid container according to claim 2, wherein the liquid is retained over an entire area of the interface of the press contact portion between the first and the second negative pressure producing member irrespective of an orientation taken by said liquid container.

4. A liquid container according to claim 1, further comprising a structural member provided in the space formed by said recess and contacted to said negative pressure producing member, said structural member being disposed on an extension of a contact plane between a surface of an inner wall constituting said negative pressure producing member accommodating chamber and a surface of said negative pressure producing member.

5. A liquid container according to claim 1, further comprising a projection provided in the space formed by said recess and disposed on an extension of a contact plane between a surface of an inner wall constituting said negative pressure producing member accommodating chamber and a surface of said negative pressure producing member, said projection being effective to block a direct fluid communication between a surface of said negative pressure producing member directly contacting the liquid and said contact plane.

6. A liquid container according to claim 1, further comprising a structural member disposed on an extension of an apex line where inner walls constituting said negative pressure producing member accommodating chamber cross with each other, wherein said structural member has a dimension in a direction crossing with said apex line.

* * * * *